US008828920B2

(12) United States Patent
Chawla et al.

(10) Patent No.: US 8,828,920 B2
(45) Date of Patent: Sep. 9, 2014

(54) PRODUCT FOR PRE-TREATMENT AND LAUNDERING OF STAINED FABRIC

(75) Inventors: Nalini Chawla, Mason, OH (US); Tom Patrick Collins, Mason, OH (US); Michael David Sanders, Cincinnati, OH (US); Sherri Lynn Randall, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 257 days.

(21) Appl. No.: 13/166,872

(22) Filed: Jun. 23, 2011

(65) Prior Publication Data

US 2012/0324653 A1 Dec. 27, 2012

(51) Int. Cl.
*D06L 1/20* (2006.01)
*B67D 7/06* (2010.01)

(52) U.S. Cl.
USPC ..... 510/405; 222/153.06; 222/562; 264/268; 264/242; 8/137

(58) Field of Classification Search
USPC ..... 510/405; 8/137; 222/562, 153.06; 264/268.242
See application file for complete search history.

(56) References Cited

U.S. PATENT DOCUMENTS

| | | | | |
|---|---|---|---|---|
| 3,853,250 | A * | 12/1974 | Alpern | 222/517 |
| 3,860,148 | A * | 1/1975 | Sherin | 222/153.06 |
| 4,676,921 | A | 6/1987 | Vander Meer | |
| 4,767,034 | A | 8/1988 | Cramer | |
| 4,797,898 | A | 1/1989 | Martinez | |
| 5,181,630 | A | 1/1993 | McNally | |
| 5,388,298 | A | 2/1995 | Rutter et al. | |
| 5,466,394 | A | 11/1995 | de Buzzaccarini et al. | |
| 5,549,209 | A | 8/1996 | Weissman et al. | |
| 5,971,645 | A * | 10/1999 | Fukushima et al. | 401/183 |
| 6,017,871 | A | 1/2000 | Baeck et al. | |
| 6,367,670 | B1 * | 4/2002 | Warner et al. | 222/556 |
| 6,375,041 | B1 * | 4/2002 | Klima et al. | 222/129 |
| 6,855,680 | B2 | 2/2005 | Smerznak et al. | |
| 6,874,190 | B2 | 4/2005 | Deflander et al. | |
| 7,294,611 | B2 | 11/2007 | Metrot et al. | |
| 2008/0015135 | A1 | 1/2008 | de Buzzaccarini et al. | |
| 2008/0032909 | A1 | 2/2008 | de Buzzaccarini et al. | |
| 2009/0124531 | A1 | 5/2009 | Danziger et al. | |
| 2009/0156317 | A1 | 6/2009 | Degler et al. | |
| 2009/0172895 | A1 | 7/2009 | Lant et al. | |
| 2009/0176684 | A1 * | 7/2009 | Gardner et al. | 510/392 |
| 2009/0215662 | A1 | 8/2009 | Boeckh et al. | |
| 2009/0286709 | A1 | 11/2009 | Sadlowski et al. | |
| 2009/0298735 | A1 | 12/2009 | Boeckh et al. | |
| 2009/0312221 | A1 | 12/2009 | Lant et al. | |
| 2010/0081601 | A1 * | 4/2010 | Boutique et al. | 510/295 |
| 2011/0065624 | A1 | 3/2011 | Boutique et al. | |
| 2011/0071079 | A1 | 3/2011 | Ameer et al. | |
| 2011/0119841 | A1 | 5/2011 | Bennett et al. | |
| 2011/0162151 | A1 | 7/2011 | Chawla et al. | |
| 2011/0179585 | A1 * | 7/2011 | Chawla et al. | 8/137 |
| 2011/0179586 | A1 * | 7/2011 | Chawla et al. | 8/137 |
| 2011/0179587 | A1 * | 7/2011 | Chawla et al. | 8/137 |
| 2011/0311296 | A1 * | 12/2011 | Chawla et al. | 401/137 |
| 2012/0324655 | A1 * | 12/2012 | Chawla et al. | 8/137 |

FOREIGN PATENT DOCUMENTS

| | | | |
|---|---|---|---|
| GB | 2168931 | A | 7/1986 |
| WO | WO 00 20676 | * | 4/1998 |
| WO | WO 0027958 | * | 5/2000 |
| WO | WO 2008/087497 | A1 | 7/2008 |
| WO | WO 2009/156317 | A1 | 12/2009 |
| WO | WO 2010/028941 | A1 | 3/2010 |

OTHER PUBLICATIONS

International Search Report dated Sep. 16, 2011 containing 4 pages.
U.S. Appl. No. 12/820,538, filed Jun. 22, 2010, Nalini Chawla, et al.
U.S. Appl. No. 12/963,681, filed Dec. 9, 2010, Philip Frank Souter, et al.
U.S. Appl. No. 13/024,627, filed Feb. 10, 2011, Michelle Meek, et al.
U.S. Appl. No. 13/032,666, filed Feb. 23, 2011, Eugene Steven Sadlowski, et al.
U.S. Appl. No. 61/500,335, filed Jun. 23, 2011, Nalini Chawla, et al.
Photographs of a dosing ball sold with a Henkel Persil Gold 1.5L bottle that was purchased in Sep. 2009.

* cited by examiner

*Primary Examiner* — Mark Eashoo
*Assistant Examiner* — M. Reza Asdjodi
(74) *Attorney, Agent, or Firm* — Gregory S. Darley-Emerson; Steven W. Miller

(57) ABSTRACT

A product for pre-treatment and laundering of fabric having a stained portion. The product comprising a pourable aqueous detergent composition and a dispensing cap. The cap can have a pour volume sized and dimensioned to provide for a unit dose of the detergent composition. A portion of the cap can be provided with surface irregularities for scrubbing a stain.

17 Claims, 12 Drawing Sheets

PRODUCT FOR PRE-TREATMENT AND LAUNDERING OF STAINED FABRIC

FIELD OF THE INVENTION

A product for pre-treatment and laundering of a stained fabric.

BACKGROUND OF THE INVENTION

Treating stained garments is an aspect of laundering that could be improved. There are a variety of commercially available approaches for treating stains. In one approach the consumer merely washes with a detergent touted as having the ability to treat stains. Such an approach tends to work satisfactorily if the stains are light and not greasy. If the stains are heavy, particularly heavy greasy stains, the stains might not be removed because the chemical ingredients of detergent are diluted in the wash and are not concentrated at the stain. This can leave the consumer dissatisfied when, at the end of the wash cycle, the stains are still visible. The prospects for successful stain treatment after washing are limited, particularly if the failure is not detected until after drying the stained garment.

In another approach to treating stains, a separate stain treatment aid may be applied to the stain, e.g., by spraying or squirting the stain treatment aid directly on the stain or using a wipe impregnated with a stain treatment aid to scrub a stain. Some stain treatment aids include a motorized brush or scrubbing implement to assist with treating the stain in the fabric. This approach, however, requires the consumer to purchase and use multiple products—detergent, stain treatment aid, and any accompanying devices. The consumer must store all of these items near the washing machine, frequently in an unsightly gathering of laundry products. The consumer must remember to treat stains prior to placing stained garments in the washing machine. The consumer must locate the stain treatment aid and manipulate the packaging or device to apply the stain treatment aid to the stain. After applying the stain treatment aid, the consumer must then open the laundry detergent, measure out an appropriate dose, and deliver the dose of detergent to the washing machine. Finally, the consumer must store the laundry detergent. This multistep process is a less than desirable consumer experience, particularly given all the other demands on the consumer's time.

In yet another approach, some liquid detergents may be used to pre-treat stains through the local application of a small quantity of detergent to the stained portion of the garment. However, it can be difficult to pour a small quantity of detergent and apply it to a stain, when the detergent package is not designed for such pretreat dosing. Also, consumers may not remember to pretreat stains, when there is no signal or reminder to pretreat associated with the detergent. Finally, the use of a neat portion of liquid detergent may not provide for the consumer-desired removal of a wide range of stains. For example, exposing a stained fabric to the high level of hydrophobic surfactants found in some liquid detergents may provide for good greasy stain removal, but it may not provide for good bleachable stain (e.g., beverage stain) removal.

With these limitations in mind, there is a continuing unaddressed need for a product and approach for treating stains that intuitively suggests to the consumer to treat stains properly, is intuitive for the consumer to remember to apply, is simple to apply, and that provides effective removal of a variety of stains with a single product. The present invention addresses the aforementioned needs by providing an "all-in-one" product for pre-treatment and laundering of fabric. This all-in-one product comprises a novel combination of a cap and a detergent composition that allows for the removal of a wide range of stains, as described in greater detail hereinafter.

SUMMARY OF THE INVENTION

The present invention attempts to solve one more of the aforementioned needs by providing, in one aspect of the invention, a product for pre-treatment and laundering of fabric having a stained portion, the product comprising a pourable aqueous detergent composition and a cap for dispensing said pourable aqueous detergent composition:

A. the pourable aqueous detergent composition comprising:
   a) a hydrophobic surfactant system having a Hydrophilic Index of from about 6 to about 9;

B. the cap comprising:
   a) a base having a base interior and a base exterior opposing said base interior, said base interior having a periphery; and
   b) a vessel wall having an interior surface and an exterior surface opposing said interior surface, the vessel wall extending from the periphery to a rim, the interior surface and the base interior defining a pour volume, the base interior forming a closed end of said pour volume;

wherein:
   i. the cap is sealingly engaged to a container containing said detergent composition by a connector disposed on said cap and a corresponding receiver disposed on an opening of said container;
   ii. the pour volume is sized and dimensioned to provide for a unit dose of the detergent composition; and
   iii. the cap further comprises a plurality of first surface irregularities at a location selected from the group consisting of: on the rim, on the base exterior, between the connector disposed on the cap and the rim, and combinations thereof.

DETAILED DESCRIPTION OF THE INVENTION

Figure 1:
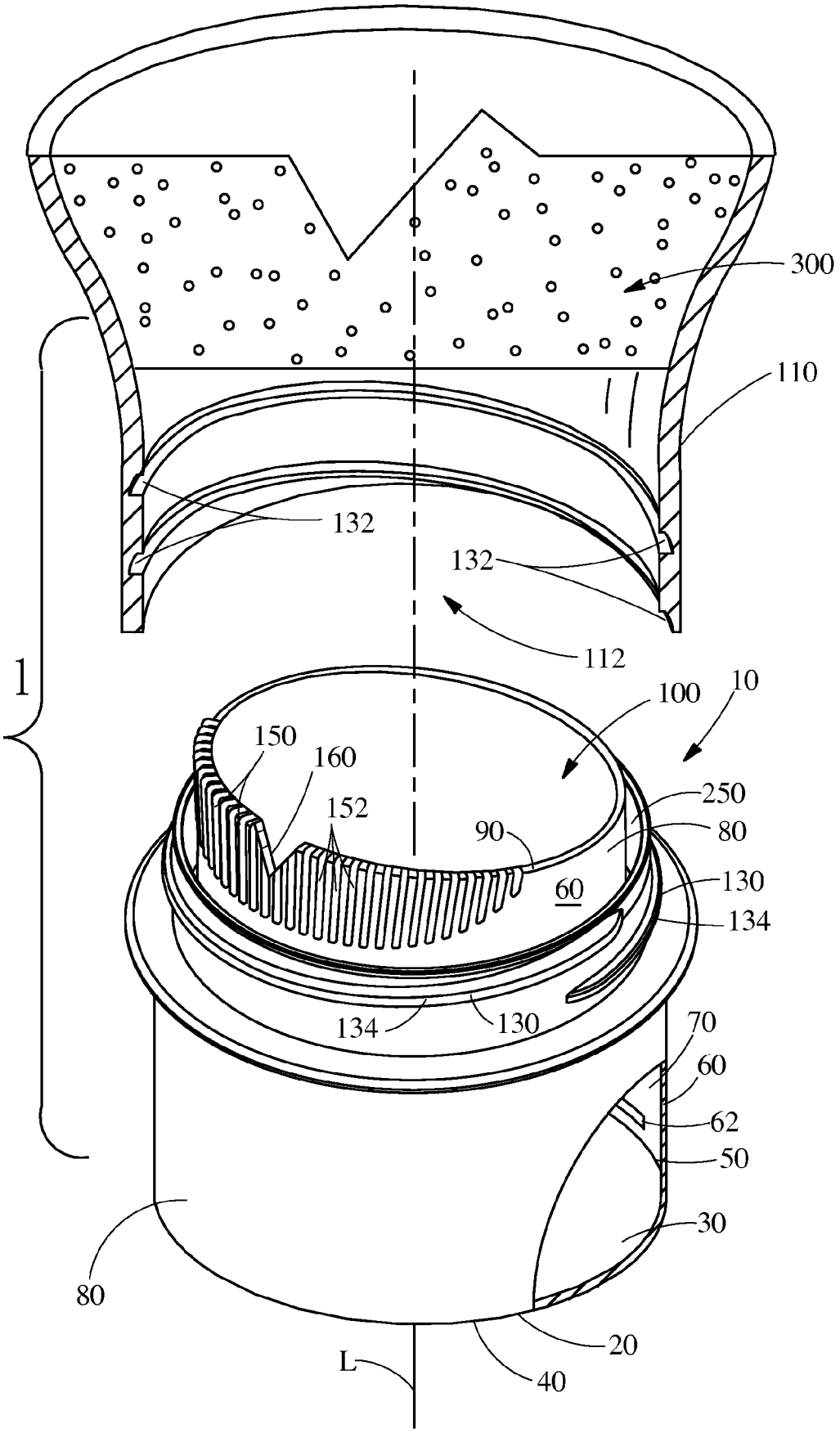
FIG. 1 is a schematic of a cap having first surface irregularities.

As used herein, the articles "a" and "an" when used in a claim, are understood to mean one or more of what is claimed or described.

As used herein, "front-end stability agent" means an agent that is added directly to a fabric softener active, before the fabric softener active is hydrated and before it is combined with the remaining components of the fabric softener composition (e.g., perfume, silicones, polymers).

As used herein, the terms "include," "includes," and "including" are meant to be non-limiting.

As used herein, "pourable" refers to a liquid having a viscosity of less than about 7000 cPs, typically less than about 5000 cPS, more typically less than about 2000 cPs, even more typically less than about 1000 cPs, even more typically less than about 750 cPS, most typically less than about 600 cPs and a viscosity greater than about 50 cPs, typically greater than about 100 cPs, more typically greater than about 150 cPs, even more typically greater than about 300 cPs, most typically greater than about 350 cPs. Viscosity is measured at a shear rate of 20/s at 21 C.

Unless otherwise noted, all component or composition levels are in reference to the active portion of that component or composition, and are exclusive of impurities, for example, residual solvents or by-products, which may be present in commercially available sources of such components or compositions.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Product for Pre-Treatment and Laundering of a Stained Fabric

The present invention addresses the need for a product and approach for treating stains that intuitively suggests to the consumer to treat stains properly, is intuitive for the consumer to remember to apply, is simple to apply, and provides effective removal of a variety of stains with a single product by providing an "all-in-one" product for pre-treatment and laundering of fabric. This all-in-one product comprises a novel combination of a cap and a detergent composition. The cap serves both as a visual reminder to the consumer to pre-treat stains and a built-in stain treatment applicator, particularly for particulate stains, e.g., clay and makeup. The detergent composition is formulated to remove, in particular, greasy stains. Specifically, the detergent composition may include a surfactant system having a low Hydrophilic Index to provide for the removal of greasy stains. Thus, the combination of the detergent composition and the cap of the invention enables the removal of a wide variety of stains, from greasy stains to particulate stains.

Pourable Aqueous Detergent Composition

The compositions according to the invention can dispensed in any suitable way including, but not limited to, being poured from a spout and/or delivered from a squeezable bottle.

The viscosity and the rheology of the products according to the invention will be tuned by one skilled in the art so that the product has a low enough viscosity to be released in the wash without leaving residues on fabrics, on the cap or washing machine parts, and a high enough viscosity so that it does not flow too easily increasing the risk of splashes and of messiness."

The pourable aqueous detergent composition according to the present invention may comprise a hydrophobic surfactant system. The detergent composition may further comprise an ingredient selected from a chelant system, a builder, water, an enzyme, and other ingredients.

Hydrophobic Surfactant System

As used herein, a "hydrophobic surfactant system" has a "Hydrophilic Index" of from about 6 to about 9, from about 7 to about 8.5, or from about 7.5 to 8.0. Any combination of surfactants that provide for a hydrophobic surfactant system having a "Hydrophilic Index" of from about 6 to about 9, are of use. The detergent compositions may comprise by weight percentage from about 5% to about 50%, from about 10% to about 42% or from about 15% to about 31% of total surfactant. The surfactant system comprises surfactant selected from the group of: anionic, nonionic, cationic, zwitterionic, amphoteric surface active agents and mixtures thereof.

Anionic Surfactants

Suitable anionic surfactants may be any of the conventional anionic surfactant types typically used in liquid detergent products. Such surfactants include the alkyl benzene sulfonic acids and their salts as well as alkoxylated or non-alkoxylated alkyl sulfate materials. Exemplary anionic surfactants are the alkali metal salts of $C_{10}$-$C_{16}$ alkyl benzene sulfonic acids, preferably $C_{11}$-$C_{14}$ alkyl benzene sulfonic acids. In one aspect, the alkyl group is linear. Such linear alkyl benzene sulfonates are known as "LAS". Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$ LAS, e.g., $C_{12}$ LAS, are a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: R'—O—$(C_2H_4O)_n$—$SO_3M$ wherein R' is a $C_8$-$C_{20}$ alkyl group, n is from about 1 to 20, and M is a salt-forming cation. In a specific embodiment, R' is $C_{10}$-$C_{18}$ alkyl, n is from about 1 to 15, and M is sodium, potassium, ammonium, alkylammonium, or alkanolammonium. In more specific embodiments, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoyxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3^-M^+$ wherein R is typically a $C_8$-$C_{20}$ alkyl group, which may be straight chain or branched chain, and M is a water-solubilizing cation. In specific embodiments, R is a $C_{10}$-$C_{15}$ alkyl group, and M is alkali metal, more specifically R is $C_{12}$-$C_{14}$ alkyl and M is sodium.

Specific, non-limiting examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3)-alkyl sulfates having formulae (I) and (II):

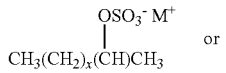

(I)

or

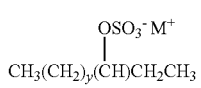

(II)

wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) alkyl alkoxy sulfates ($AE_zS$) wherein preferably z is from 1-30; e) $C_{10}$-$C_{18}$ alkyl alkoxy carboxylates preferably comprising 1-5 ethoxy units; f) mid-chain branched alkyl sulfates as discussed in U.S. Pat. Nos. 6,020,303 and 6,060,443; g) mid-chain branched alkyl alkoxy sulfates as discussed in U.S. Pat. Nos. 6,008,181 and 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548; i) methyl ester sulfonate (MES); and j) alpha-olefin sulfonate (AOS).

Suitable nonionic surfactants useful herein may comprise any of the conventional nonionic surfactant types typically used in liquid detergent products. These include, for example, alkoxylated fatty alcohols and amine oxide surfactants. Preferred for use in the liquid detergent products herein are those nonionic surfactants which are normally liquid. Suitable nonionic surfactants for use herein include the alcohol alkoxylate nonionic surfactants. Alcohol alkoxylates are materials which correspond to the general formula: $R^1(C_mH_{2m}O)_pOH$ wherein $R^1$ is a $C_8$-$C_{16}$ alkyl group, m is from 2 to 4, and p ranges from about 2 to 12. Preferably $R^1$ is an alkyl group which may be primary or secondary and that contains from about 9 to about 15 carbon atoms, more preferably from about 10 to about 14 carbon atoms. In one embodiment, the alkoxylated fatty alcohols may also be ethoxylated materials that contain from about 2 to about 12 ethylene oxide moieties per molecule, more preferably from about 3 to about 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Suitable alkoxylated fatty alcohol nonionic surfactants have been marketed under the tradename NEODOL® by the Shell Chemical Company.

Another suitable type of nonionic surfactant useful herein comprises the amine oxide surfactants. Amine oxides are materials which are often referred to in the art as "semi-polar" nonionics. Amine oxides have the formula: $R^2(EO)_f(PO)_g(BO)_hN(O)(CH_2R^3)_2.qH_2O$. In this formula, $R^2$ is a relatively long-chain alkyl moiety which can be saturated or unsaturated, linear or branched, and can contain from 8 to 20, preferably from 10 to 16 carbon atoms, and is more preferably a $C_{12}$-$C_{16}$ primary alkyl. $R^3$ is a short-chain moiety, preferably selected from hydrogen, methyl and —$CH_2OH$. When f+g+h is different from 0, EO is ethyleneoxy, PO is propyleneneoxy and BO is butyleneoxy. Exemplary amine oxide surfactants may be illustrated by $C_{12}$-$C_{14}$ alkyldimethyl amine oxide.

Non-limiting examples of nonionic surfactants include: a) $C_{12}$-$C_{18}$ alkyl ethoxylates, such as, NEODOL® nonionic surfactants from Shell; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as PLURONIC® from BASF; d) $C_{14}$-$C_{22}$ mid-chain branched alcohols ("BA") as discussed in U.S. Pat. No. 6,150,322; e) $C_{14}$-$C_{22}$ mid-chain branched alkyl alkoxylates ("$BAE_z$"), wherein z is 1-30, as discussed in U.S. Pat. Nos. 6,153,577; 6,020,303; and 6,093,856; f) alkyl-polysaccharides as discussed in U.S. Pat. No. 4,565,647; specifically alkylpolyglycosides as discussed in U.S. Pat. Nos. 4,483,780 and 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

Cationic surfactants are known in the art and non-limiting examples of these include quaternary ammonium surfactants, which can have up to 26 carbon atoms. Additional examples include a) alkoxylate quaternary ammonium ("AQA") surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042; 4,239,660; 4,260,529; and 6,022,844; and e) amino surfactants as discussed in U.S. Pat. No. 6,221,825 and WO 00/47708, such as amido propyldimethyl amine ("APA").

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 at column 19, line 38 through column 22, line 48, for examples of zwitterionic surfactants; betaines, including alkyl dimethyl betaine and cocodimethyl amidopropyl betaine, $C_8$ to $C_{18}$ (for example from $C_{12}$ to $C_{18}$) amine oxides and sulfo and hydroxy betaines, such as N-alkyl-N,N-dimethylammino-1-propane sulfonate where the alkyl group can be $C_8$ to $C_{18}$ and in certain embodiments from $C_{10}$ to $C_{14}$.

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents may contain at least about 8 carbon atoms, for example from about 8 to about 18 carbon atoms, and at least one contains an anionic water-solubilizing group, e.g. carboxy, sulfonate, sulfate. See U.S. Pat. No. 3,929,678 at column 19, lines 18-35, for suitable examples of ampholytic surfactants.

Nonlimiting examples of surfactant systems include the conventional $C_{11}$-$C_{18}$ alkyl benzene sulfonates ("LAS") and primary, branched-chain and random $C_{10}$-$C_{20}$ alkyl sulfates ("AS"), the $C_{10}$-$C_{18}$ secondary (2,3)-alkyl sulfates of the formula $CH_3(CH_2)_x(CHOO_3^-M^+)CH_3$ and $CH_3(CH_2)_y(CHOSO_3^-M^+)CH_2CH_3$ where x and (y+1) are integers of at least about 7, in other embodiments at least about 9, and M is a water-solubilizing cation, especially sodium, unsaturated sulfates such as oleyl sulfate, the $C_{10}$-$C_{18}$ alkyl alkoxy sulfates ("$AE_zS$"; especially EO 1-7 ethoxy sulfates), $C_{10}$-$C_{18}$ alkyl alkoxy carboxylates (especially the EO 1-5 ethoxycarboxylates), the $C_{10}$-$C_{18}$ glycerol ethers, the $C_{10}$-$C_{18}$ alkyl polyglycosides and their corresponding sulfated polyglycosides, and $C_{12}$-$C_{18}$ alpha-sulfonated fatty acid esters. If desired, the conventional nonionic and amphoteric surfactants such as the $C_{12}$-$C_{18}$ alkyl ethoxylates ("AE") including the narrow peaked alkyl ethoxylates and $C_6$-$C_{12}$ alkyl phenol alkoxylates (especially ethoxylates and mixed ethoxy/propoxlyates), $C_{12}$-$C_{18}$ betaines and sulfobetaines ("sultaines"), $C_{10}$-$C_{18}$ amine oxides, and the like, can also be included in the surfactant system. The $C_{10}$-$C_{18}$ N-alkyl polyhydroxy fatty acid amides can also be used. See WO 92/06154. Other sugar-derived surfactants include the N-alkoxy polyhydroxy fatty acid amides, such as $C_{10}$-$C_{18}$ N-(3-methoxypropyl) glucamide. The N-propyl through N-hexyl $C_{12}$-$C_{18}$ glucamides can be used for low sudsing. $C_{10}$-$C_{20}$ conventional soaps may also be used. If high sudsing is desired, the branched-chain $C_{10}$-$C_{16}$ soaps may be used. Mixtures of anionic and nonionic surfactants are especially useful. Other conventional useful surfactants are listed in standard texts.

Chelant System

The pourable aqueous compositions disclosed herein may include a chelant system. In some aspects, the chelant system comprises at least two chelants. At least one of the chelants is a strong binder of transition metals and provides for good removal of stains including, but not limited to, beverage stains. At least one of the chelants has a low calcium binding constant, which further improves beverage stain removal without destabilizing enzymes, which also be included in the composition to remove stains across a wide variety of stain categories. In some embodiments, the chelant system is a dual chelant system consisting of two chelating agents. As used herein the terms "dual chelant system" and "combination of chelants" refers to at least two chelants having different core molecular structures and does not refer to two chelants having the same core molecular structure, but different associated counterions or being different ionizable species of the same base core structure.

The combination of chelants may be chosen by one skilled in the art to provide for heavy metal (e.g. Fe) sequestration without negatively impacting enzyme stability through the excessive binding of calcium ions. Non-limiting examples of chelants of use in the present invention are found in U.S. Pat. Nos. 7,445,644, 7,585,376 and 2009/0176684A1.

Useful chelants include heavy metal chelating agents, such as diethylenetriaminepentaacetic acid (DTPA) and/or a catechol including, but not limited to, Tiron. In embodiments in which a dual chelant system is used, the chelants may be DTPA and Tiron.

DTPA has the following core molecular structure:

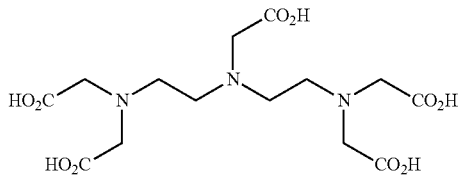

Tiron, also known as 1,2-dihydroxybenzene-3,5-disulfonic acid, is one member of the catechol family and has the core molecular structure shown below:

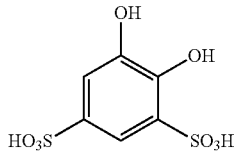

Other sulphonated catechols are of use. In addition to the disulfonic acid, the term "tiron" may also include mono- or di-sulfonate salts of the acid, such as, for example, the disodium sulfonate salt, which shares the same core molecular structure with the disulfonic acid.

Other chelating agents suitable for use herein can be selected from the group consisting of aminocarboxylates, aminophosphonates, polyfunctionally-substituted aromatic chelating agents and mixtures thereof. Chelants particularly of use include, but are not limited to: HEDP (hydroxyethanedimethylenephosphonic acid); MGDA (methylglycinediacetic acid); and mixtures thereof.

Without intending to be bound by theory, it is believed that the benefit of these materials is due in part to their exceptional ability to remove heavy metal ions from washing solutions by formation of soluble chelates; other benefits include inorganic film or scale prevention. Other suitable chelating agents for use herein are the commercial DEQUEST series, and chelants from Monsanto, DuPont, and Nalco, Inc.

Aminocarboxylates useful as chelating agents include, but are not limited to, ethylenediaminetetracetates, N-(hydroxyethyl)ethylenediaminetriacetates, nitrilotriacetates, ethylenediamine tetraproprionates, triethylenetetraaminehexacetates, diethylenetriamine-pentaacetates, and ethanoldiglycines, alkali metal, ammonium, and substituted ammonium salts thereof and mixtures thereof.

Aminophosphonates are also suitable for use as chelating agents in the compositions of the invention when at least low levels of total phosphorus are permitted in detergent compositions, and include ethylenediaminetetrakis (methylenephosphonates). Preferably, these aminophosphonates do not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A biodegradable chelator for use herein is ethylenediamine disuccinate ("EDDS"), especially (but not limited to) the [S,S] isomer as described in U.S. Pat. No. 4,704,233. The trisodium salt is preferred though other forms, such as magnesium salts, may also be useful.

The chelant system may be present in the pourable aqueous compositions of the invention at from about 0.2% to about 0.7% or from about 0.3% to about 0.6% by weight of the detergent compositions disclosed herein.

Builder

The compositions herein may comprise builder. Builders of use include, but are not limited to those materials which serve to counteract the effects of calcium, magnesium, or other ion, water hardness encountered during laundering using the compositions herein. Examples of such materials include the alkali metal citrates, succinates, malonates, carboxymethyl succinates, carboxylates, polycarboxylates and polyacetyl carboxylates. Specific examples include sodium, potassium and lithium salts of oxydisuccinic acid, mellitic acid, benzene polycarboxylic acids, $C_{10}$-$C_{22}$ fatty acids and citric acid. Other examples are organic phosphonate type sequestering agents such as those which have been sold by Monsanto under the Dequest tradename and alkanehydroxy phosphonates. Citrate salts and $C_{12}$-$C_{18}$ fatty acid soaps are highly preferred.

Other suitable organic builders include the higher molecular weight polymers and copolymers known to have builder properties. For example, such materials include appropriate polyacrylic acid, polymaleic acid, and polyacrylic/polymaleic acid copolymers and their salts, such as those sold by BASF under the Sokalan trademark.

If utilized, organic builder materials will generally comprise from 0% to about 8%, from about 3% to about 7%, or from about 2% to 6%, by weight of the composition.

Preferred builder is selected from the group of: citric acid; fatty acid; and mixtures thereof. In some embodiments, citric acid is the sole builder utilized and is present in the compositions at a weight percentage of about 4.5% or less. Without wishing to be bound by theory, it is believed that the low citric acid content provides for greater flexibility in the formulation of compacted detergents by tying up less water and reducing cost. In some embodiments, citric acid is present in the composition at less than 4%, less than 3%, less than 2% or even less than 1%.

Water

"Water" as used herein refers to the total water content in the product, which may be added directly as water, or may be added in combination with other components of the product. For example, the water can be added within a paste of solution comprising other product ingredients.

Enzyme

In some embodiments, the pourable aqueous detergent compositions comprise enzyme. In some embodiments, the compositions of the present invention include enzymes from about 0.00001% to about 5%, specifically from about 0.001% to about 2%, more specifically from about 0.00001% to about 1%, even more specifically from about 0.001% to about 0.2%, even more specifically still from about 0.005% to about 0.1%, by weight of the detergent composition, of enzyme It may be preferred for the composition to comprise at least a ternary enzyme system selected from protease, amylase, lipase and/or cellulase.

Lipase.

Suitable lipases include those of bacterial or fungal origin. Chemically modified or protein engineered mutants are included. Non-limiting examples of useful lipases include lipases from *Humicola* (synonym *Thermomyces*), e.g., from *H. lanuginosa* (*T. lanuginosus*) as described in EP 258 068 and EP 305 216 or from *H. insolens* (see WO 96/13580, a *Pseudomonas* lipase, e.g., from *P. alcaligenes* or *P. pseudoalcaligenes* (see EP 218 272), *P. cepacia* (see EP 331 376), *P. stutzeri* (see GB 1,372,034), *P. fluorescens, Pseudomonas* sp. strain SD 705 (see WO 95/06720 and WO 96/27002), *P. wisconsinensis* (see WO 96/12012), a *Bacillus* lipase, e.g., from *B. subtilis* (see Dartois et al. (1993), Biochemica et Biophysica Acta, 1131, 253-360), *B. stearothermophilus* (see JP 64/744992) or *B. pumilus* (see WO 91/16422).

The lipase may be a "first cycle lipase" such as those described in U.S. Pat. No. 6,939,702 and US PA 2009/0217464. In one aspect, the lipase is a first-wash lipase, preferably a variant of the wild-type lipase from *Thermomyces lanuginosus* comprising T231R and N233R mutations. The wild-type sequence is the 269 amino acids (amino acids 23-291) of the Swissprot accession number Swiss-Prot O59952 (derived from *Thermomyces lanuginosus* (*Humicola lanuginosa*)). Preferred lipases would include those sold under the tradenames Lipex®, Lipolex® and Lipoclean® by Novozymes, Bagsvaerd, Denmark.

In some embodiments, the composition comprises a variant of *Thermomyces lanuginosa* lipase having >90% identity with the wild type amino acid and comprising substitution(s) at T231 and/or N233, preferably T231R and/or N233R (herein: "first wash lipase").

Protease.

Suitable proteases include metalloproteases and/or serine proteases, including neutral or alkaline microbial serine proteases, such as subtilisins (see EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease.

Non-limiting examples of suitable neutral or alkaline proteases include:

(a) subtilisins (EC 3.4.21.62), including those derived from *Bacillus*, such as *Bacillus lentus, B. alkalophilus, B. subtilis, B. amyloliquefaciens, Bacillus pumilus* and *Bacillus gibsonii* described in U.S. Pat. No. 6,312,936, U.S. Pat. No. 5,679,630, U.S. Pat. No. 4,760,025, U.S. Pat. No. 7,262,042 and WO09/021,867.

(b) trypsin-type or chymotrypsin-type proteases, such as trypsin (e.g., of porcine or bovine origin), including the *Fusarium* protease described in WO 89/06270 and the chymotrypsin proteases derived from *Cellumonas* described in WO 05/052161 and WO 05/052146.

(c) metalloproteases, including those derived from *Bacillus amyloliquefaciens* described in WO 07/044,993.

Preferred proteases include those derived from *Bacillus gibsonii* or *Bacillus Lentus.*

Suitable commercially available protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase® and Esperase® by Novozymes A/S (Denmark), those sold under the tradename Maxatase®, Maxacal®, Maxapem®, Properase®, Purafect®, Purafect Prime®, Purafect Ox®, FN3®, FN4®, Excellase® and Purafect OXP® by Genencor International, those sold under the tradename Opticlean® and Optimase® by Solvay Enzymes, those available from Henkel/Kemira, namely BLAP (sequence shown in FIG. 29 of U.S. Pat. No. 5,352,604 with the following mutations S99D+S101 R+S 103A+V104I+G159S, hereinafter referred to as BLAP), BLAP R (BLAP with S3T+V4I+V199M+V205I+L217D), BLAP X (BLAP with S3T+V4I+V205I) and BLAP F49 (BLAP with S3T+V4I+A194P+V199M+V205I+L217D)—all from Henkel/Kemira; and KAP (*Bacillus alkalophilus* subtilisin with mutations A230V+S256G+S259N) from Kao.

In some embodiments, the composition comprises a subtilisin protease selected from BLAP, BLAP R, BLAP X or BLAP F49.

Cellulase.

Suitable cellulases include those of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. No. 4,435,307, U.S. Pat. No. 5,648,263, U.S. Pat. No. 5,691,178, U.S. Pat. No. 5,776,757 and WO 89/09259.

In one aspect, the cellulase can include microbial-derived endoglucanases exhibiting endo-beta-1,4-glucanase activity (E.C. 3.2.1.4), including a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403 and mixtures thereof. A suitable endoglucanases is sold under the tradename Celluclean® (Novozymes A/S, Bagsvaerd, Denmark). Further suitable endoglucanases are variants of the XYG1006 enzyme described in U.S. Pat. No. 7,361,736 (Novozymes). A suitable endoglucanase is sold under the tradename Whitezyme® (Novozymes A/S, Bagsvaerd, Denmark).

In some embodiments, the composition comprises a cleaning cellulase belonging to Glycosyl Hydrolase family 45 having a molecular weight of from 17 kDa to 30 kDa, for example the endoglucanases sold under the tradename Biotouch® NCD, DCC and DCL (AB Enzymes, Darmstadt, Germany).

Amylase.

Preferably, the composition comprises an amylase with greater than 60% identity to the AA560 alpha amylase endogenous to *Bacillus* sp. DSM 12649, preferably a variant of the AA560 alpha amylase endogenous to *Bacillus* sp. DSM 12649 having:

(a) mutations at one or more of positions 9, 26, 149. 182, 186, 202, 257, 295, 299, 323, 339 and 345; and (b) optionally with one or more, preferably all of the substitutions and/or deletions in the following positions: 118, 183, 184, 195, 320 and 458, which if present preferably comprise R118K, D183*, G184*, N195F, R320K and/or R458K.

Suitable commercially available amylase enzymes include Stainzyme® Plus, Stainzyme®, Natalase, Termamyl®, Termamyl® Ultra, Liquezyme® SZ (all Novozymes, Bagsvaerd, Denmark) and Spezyme® AA or Ultraphlow (Genencor, Palo Alto, USA).

Choline Oxidase.

The composition may comprise a choline oxidase enzyme such as the 59.1 kDa choline oxidase enzyme endogenous to *Arthrobacter nicotianae*, produced using the techniques disclosed in D. Ribitsch et al., *Applied Microbiology and Biotechnology*, Volume 81. Number 5, pp 875-886, (2009).

Other Enzymes.

Other suitable enzymes are peroxidases/oxidases, which include those of plant, bacterial or fungal origin. Chemically modified or protein engineered mutants are included. Examples of useful peroxidases include peroxidases from *Coprinus*, e.g., from *C. cinereus*, and variants thereof as those described in WO 93/24618, WO 95/10602, and WO 98/15257.

Commercially available peroxidases include GUARDZYME® (Novozymes A/S).

Other preferred enzymes include: pectate lyases sold under the tradenames Pectawash®, Pectaway®; mannanases sold under the tradenames Mannaway® (all from Novozymes A/S, Bagsvaerd, Denmark), and Purabrite® (Genencor International Inc., Palo Alto, Calif.); cutinases; laccases; phospholipases; lysophospholipases; acyltransferase; perhydrolase; arylesterase and any mixture thereof.

Other Ingredients

Hueing Dye

In some embodiments, the pourable aqueous detergent composition comprises hueing dye. Any suitable hueing dye may be of use. Non-limiting examples of useful hueing dyes include those found in USPN: U.S. Pat. No. 7,205,269; U.S. Pat. No. 7,208,459; and U.S. Pat. No. 7,674,757 B2. For example, hueing dye may be selected from the group of: triarylmethane blue and violet basic dyes, methine blue and violet basic dyes, anthraquinone blue and violet basic dyes, azo dyes basic blue 16, basic blue 65, basic blue 66 basic blue 67, basic blue 71, basic blue 159, basic violet 19, basic violet 35, basic violet 38, basic violet 48, oxazine dyes, basic blue 3, basic blue 75, basic blue 95, basic blue 122, basic blue 124, basic blue 141, Nile blue A and xanthene dye basic violet 10, an alkoxylated triphenylmethane polymeric colorant; an alkoxylated thiopene polymeric colorant; thiazolium dye; and mixtures thereof.

Preferred hueing dyes include the whitening agents found in WO 08/87497 A1. These whitening agents may be characterized by the following structure (I):

(I)

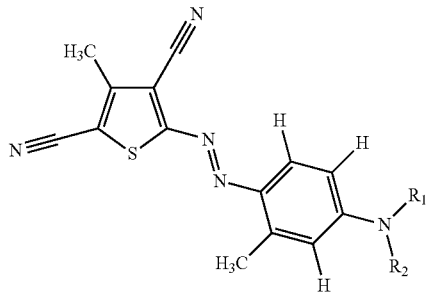

Wherein $R_1$ and $R_2$ can independently be selected from:

a) $[(CH_2CR'HO)_x(CH_2CR''HO)_yH]$
   wherein R' is selected from the group consisting of H, $CH_3$, $CH_2—O—(CH_2CH_2O)_zH$, and mixtures thereof; wherein R" is selected from the group consisting of H, $CH_2—O—(CH_2CH_2O)_zH$, and mixtures thereof; wherein $x+y\leq5$; wherein $y\geq1$; and wherein z=0 to 5;

b) $R_1$=alkyl, aryl or aryl alkyl and $R_2=[(CH_2CR'HO)_x(CH_2CR''HO)_yH]$
   wherein R' is selected from the group consisting of H, $CH_3$, $CH_2—O—(CH_2CH_2O)_zH$, and mixtures thereof; wherein R" is selected from the group consisting of H, $CH_2—O—(CH_2CH_2O)_zH$, and mixtures thereof; wherein $x+y\leq10$; wherein $y\geq1$; and wherein z=0 to 5;

c) $R_1=[CH_2CH_2(OR_3)CH_2OR_4]$ and $R_2=[CH_2CH_2(OR_3)CH_2OR_4]$
   wherein $R_3$ is selected from the group consisting of H, $(CH_2CH_2O)_zH$, and mixtures thereof; and wherein z=0 to 10;
   wherein $R_4$ is selected from the group consisting of $(C_1$-$C_{16})$alkyl, aryl groups, and mixtures thereof; and d) wherein R1 and R2 can independently be selected from the amino addition product of styrene oxide, glycidyl methyl ether, isobutyl glycidyl ether, isopropylglycidyl ether, t-butyl glycidyl ether, 2-ethylhexylgycidyl ether, and glycidylhexadecyl ether, followed by the addition of from 1 to 10 alkylene oxide units.

A preferred whitening agent of the present invention may be characterized by the following structure (II):

(II)

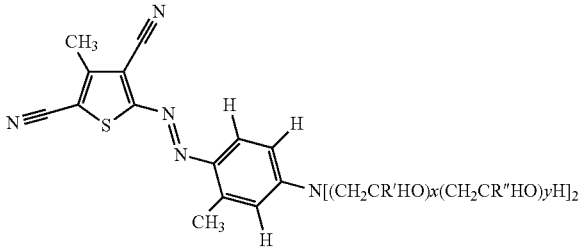

R' = H, $CH_3$, $CH_2O(CH_2CH_2O)zH$
R'' = H, $CH_2O(CH_2CH_2O)zH$ wherein R' is selected from the group consisting of H, $CH_3$, $CH_2$—O—$(CH_2CH_2O)_zH$, and mixtures thereof; wherein R'' is selected from the group consisting of H, $CH_2$—O—$(CH_2CH_2O)_zH$, and mixtures thereof; wherein $x+y\leq 5$; wherein $y\geq 1$; and wherein z=0 to 5.

A further preferred whitening agent of the present invention may be characterized by the following structure (III):

(III)

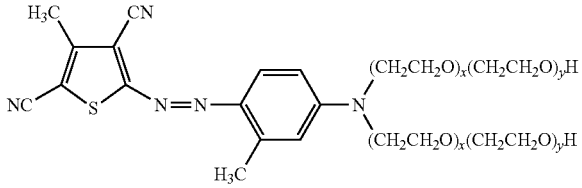

In some aspects, the whitening agent characterized by structure III is a mixture having a total of 5 EO groups. This structure is arrived at by the following selection in Structure I of the following pendant groups in "part a" above:

| | R1 | | | | R2 | | | |
|---|---|---|---|---|---|---|---|---|
| | R' | R'' | x | y | R' | R'' | x | y |
| a | H | H | 3 | 1 | H | H | 0 | 1 |
| b | H | H | 2 | 1 | H | H | 1 | 1 |
| c = b | H | H | 1 | 1 | H | H | 2 | 1 |
| d = a | H | H | 0 | 1 | H | H | 3 | 1 |

Further whitening agents of use include those described in USPN 2008 34511 A1 (Unilever). A preferred agent is "Violet 13" as pictured on p. 4 of this publication.

Structurant

In some embodiments of the present invention, the liquid laundry detergent compositions further comprise structurant. Structurants of use include those disclosed in USPN 2006/0205631A1, 2005/0203213A1, 7294611, 6855680. U.S. Pat. No. 6,855,680 defines suitable hydroxyfunctional crystalline materials in detail. Preferred is hydrogenated castor oil. Non-limiting examples of useful structurants include those selected from the group of: hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof. In some embodiments, Alternately, low molecular weight organogellants can be used. Such materials are defined in: *Molecular Gels, Materials with Self-Assembled Fibrillar Networks*, Edited by Richard G. Weiss and Pierre Terech.

Pearlescent Agent

In some embodiments of the present invention, the liquid laundry detergent compositions further comprise pearlescent agent. Pearlescent agents of use include those described in USPN 2008/0234165A1. Non-limiting examples of pearlescent agents may be selected from the group of: mica; titanium dioxide coated mica; bismuth oxychloride; fish scales; mono and diesters of alkylene glycol of the formula:

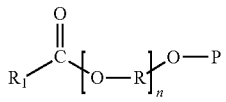

wherein:

a. $R_1$ is linear or branched C12-C22 alkyl group;

b. R is linear or branched C2-C4 alkylene group;

c. P is selected from the group of: H; C1-C4 alkyl; or —$COR_2$; and d. n=1-3.

In some embodiments, R2 is equal to R1, such that the alkylene glycol is ethyleneglycoldistearate (EGDS).

Stains

The product of the present invention provides for effective removal of a variety of stains. Non-limiting examples of stains include: greasy stains (included saturated and/or unsaturated); outdoor stains; red stains; beverage stains; blood; food stains; and mixtures thereof. Non-limiting examples of saturated greasy stains include taco grease, bacon grease and hamburger grease. Non-limiting examples of unsaturated stains include olive oil, canola oil, margarine and Italian dressing. Non-limiting examples of outdoor stains include grass and clays (organic and/or inorganic). Non-limiting examples of red stains include ketchup and tomato sauce. Non-limiting examples of beverage stains include grape juice, wine, soda and Coolaid™. Further non-limiting examples of stains include cosmetics, blood, chocolate, gravy and fruit stains.

Cap

FIG. 1 illustrates an embodiment of a cap 10 for dispensing a detergent composition 300 that can be used to pre-treat stains. The cap 10 comprises a base 20. The base 20 has a base interior 30 and a base exterior 40 opposing the base interior 30. The base interior 30 has a periphery 50. The base 20 can be a single layer of material, such as high density polyethylene or polypropylene, a multilayered material, a hollow member, or any other such structure or material having sufficient structural integrity to be used in a cap 10 for a container 110 of laundry detergent composition 300. The base exterior 40 can provide a surface arrangement that can be stably set upon another surface that is substantially flat as measured on a scale of centimeters, such as a table or a flat portion of a washing machine or dryer. Such surface arrangement can be a generally flat surface or contoured surface arrangement. When the base 20 is set on a flat surface, detergent composition 300 from a container 110 can be poured into the pour volume 100 of the cap 10 and the cap 10 will not easily tip over as detergent composition 300 is poured into the pour volume 100.

A vessel wall 60 extends from the periphery 50 to a rim 90. The vessel wall 60 extends about the longitudinal axis L of the cap. The vessel wall 60 has an interior surface 70 and an exterior surface 80 opposing the interior surface 70. The vessel wall 60 can be a single layer of material, such as high density polyethylene or polypropylene, a multilayered material, a hollow member, or any other such structure or material having sufficient structural integrity tope used as a cap 10 for a container of laundry detergent composition 300. The interior surface 70 can be provided with one or more indicia 62 that mark the desired level of detergent composition 300 that provides for an appropriate unit dose of detergent composition 300. The indicia 62 can be an etch, a depression, a raised portion, printing, or any other structure that is observable by the consumer. The vessel wall 60 can be a cylindrical segment.

The interior surface 70 and base interior 30 together define a pour volume 100, the base interior 30 forming a closed end of the pour volume 100. The pour volume 100 can be sized and dimensioned to provide for a unit dose of a detergent composition 300. The detergent composition 300 can be a liquid detergent composition 300 such as any of the liquid detergents marketed as TIDE, available from The Procter & Gamble Co., Cincinnati, Ohio, USA. In one embodiment, the interior surface 70 and base interior 30 together form an open ended, or partially open ended, cup with the base interior 30 forming the closed end of the cup. The longitudinal axis L can extend through the open portion of the open end of the cap 10 defined by or partially by the rim 90.

The interior surface 70 of the vessel wall 60 can be defined by a surface of revolution about the longitudinal axis L. In one embodiment, interior surface 70 of the vessel wall 60 can be defined by a portion of the interior surface of a hollow cylinder. Surfaces of revolutions of functions not parallel to the longitudinal axis L and surfaces of revolution of non-linear functions are contemplated. A cap 10 having an interior surface 70 of vessel wall 60 that is a surface of revolution can provide for ease of manufacture of the cap 10 and engaging the cap 10 with the container 110 after filling the container 110 with detergent composition 300 during manufacture and packaging.

The cap 10 can be sealingly engaged to a container 110 containing a detergent composition 300. By sealingly engaged, it is meant that the cap 10 does not leak an unacceptable quantity of detergent composition 300 from the container under stresses to the cap 10 and container 110 that occur during manufacturing, packaging, shipping, handling, storage, and use of the container 110 and detergent composition 300 stored therein. The cap 10 can be sealingly engaged to the container by a connector 130 disposed on the cap 10 and a corresponding receiver 132 disposed on an opening 112 of the container. The connector 130 and corresponding receiver 132 can be a lug and groove combination, the combination being arranged such the lug can be the connector 130 or the receiver 132 and the groove being whichever of the connector 130 and receiver 132 that the lug is not. The connector 130 and receiver 132 can be interlocking correspondingly disposed threads 134 helically disposed on the cap 10 and container 110. That is, the connector 130 can be threads and the receiver 132 can be corresponding threads. The cap 10 can be sealingly engaged to the container by threads 134 helically disposed on the cap 10 and corresponding disposed threads 134 on the opening 112 of the container 110. The cap 10 can be provided with a connector 130 at any suitable location such that the connector 130 can be operatively engaged with the receiver 132 on the container 110. The connector 130 can be disposed on the exterior surface 80 of the vessel wall 60. The connector 130 can be disposed on the interior surface 70 of the vessel wall 60. The cap 10 can be provided with threads 134 in any suitable location such that the threads 134 can be operatively engaged with the container 110. The threads 134 can be disposed on the exterior surface 80 of the vessel wall 60. The threads 134 can be disposed on the interior surface 70 of the vessel wall 60, which can provide for cleaner use of the cap 10. The cap 10 can be releasably attachable to a container 110 by a pressure fitting and detachable there from.

As shown in FIG. 1, the rim 90 can have a weir 160. A weir 160 can provide for more precise delivery of detergent composition 300 to a stain in a fabric by constricting the flow of detergent composition 300 from the cap 10 as a small quantity of detergent composition 300 is applied to the stain. The weir 160 can be any of the common shapes for weirs including a V shape, a semicircular shape, a trapezoidal shape, a multilevel weir having discontinuous function describing the hydraulic radius, or any other such shape that can constrict flow of detergent composition 300.

The cap 10 can comprise a plurality of first surface irregularities 150 at a location selected from the group consisting of on the rim 90, on the exterior surface 80 between the connector 130 and the rim 90, and combinations thereof. For instance, as shown in FIG. 1, the first surface irregularities 150 are illustrated as being on the rim 90 and between the connector 130 and the rim 90. The first surface irregularities 150 can be on the rim 90. The first surface irregularities 150 can be within about 5 mm of the rim 90. The first surface irregularities 150 can be on or within about 5 mm of the rim 90. The first surface irregularities 150 can be on the rim 90 and between the connector 130 disposed on the cap 10 and the rim 90. When the consumer grips the cap 10 to execute pouring, once the pour is made, first surface irregularities 150 located as such are in position to be used to scrub the stain on the fabric with the first surface irregularities 150 without requiring the consumer to reposition the cap in her hand. Further, by placing the first surface irregularities 150 as such, after using the cap 10 to pre-treat and dose the detergent composition 300, the first surface irregularities 150, which might have a small amount of detergent composition 300 remaining thereon, can fit back within the opening 112 of the container 110 to keep any mess inside the container 110.

First surface irregularities 150 can provide a topographically diverse surface that can be rubbed against a stained fabric before or after detergent composition 300 is applied to a stain in a fabric as part of a stain pretreatment process. A topographically diverse surface is a surface that is not smooth. The first surface irregularities 150 when rubbed against a stain on a fabric are thought to help dislodge agglomerations of the stain, deform the fibrous structure of the fabric allowing the detergent composition 300 to more completely penetrate the fibrous structure, and manipulate the fibers of the fabric thereby allowing a greater surface area of the fibers to be wetted with the detergent composition 300. Without being bound by theory, it is believed that dislodging agglomerations of the stain, more completely penetrating the stained fabric with detergent composition 300, and applying detergent composition 300 to a greater surface area of fibers can improve the efficacy of pre-treatment of stains in fabrics.

The plurality of first surface irregularities 150 can have a surface topography that is distinct from the surface topography of portions of the cap 10 adjacent the plurality of first surface irregularities 150. The first surface irregularities 150 can provide for a surface having a plurality of peaks and a plurality of low portions that have an amplitude between adjacent peaks and low portions greater than about 0.1 mm. The first surface irregularities 150 can provide for a surface having a plurality of peaks and a plurality of low portions that have an amplitude between adjacent peaks and low portions greater than about 0.2 mm. The first surface irregularities 150 can provide for a surface having a plurality of peaks and a plurality of low portions that have an amplitude between adjacent peaks and low portions greater than about 0.5 mm. The first surface irregularities 150 can provide for a surface having a plurality of peaks and a plurality of low portions that have an amplitude between adjacent peaks and low portions greater than about 1 mm. The low portions can be valleys. The plurality of first surface irregularities 150 can define a region that has a surface topography that differs from the surface topography of portions of the cap 10 adjacent the region. The first surface irregularities 150 can be a series of elevated portions having intermittently disposed recessed portions. Recessed portions can be continuous. Elevated portions can be continuous.

The rim 90 can have a weir 160 that is generally aligned with the first surface irregularities 150. In such an embodiment, by generally aligned it is meant that the weir 160 and first surface irregularities 150 are at least within about 0.25π radians of one another about the longitudinal axis L. For instance, as shown in FIG. 1, the weir 160 can be aligned with the first surface irregularities 150. Such an embodiment can be practical because as the user of the cap 10 dispenses the detergent composition 300 over the weir 160 to pre-treat the stain, the consumer will be holding the cap 10 in a position such that the user does not have to reposition her hand to rub the first surface irregularities 150 against the stain. Further, as the consumer observes the pour, she is likely to see the first surface irregularities 150, which will provide her with a visual cue to use the first surface irregularities 150 to scrub the stain.

Further, with the first surface irregularities 150 positioned as such, the user is able to see the first surface irregularities 150 when pouring of a unit dose is initiated. This can be practical as a reminder to the consumer to pre-treat stains if she sees the surface irregularities 150 as she pours the unit dose into the wash basin prior to pre-treating stains.

In one embodiment, the first surface irregularities 150 can comprise a first material and another portion of the cap 10 next to the first material can comprise a second material, wherein the first material and the second material differ from one another. In one embodiment, the first surface irregularities 150 can comprise a first material and another portion of the cap 10 next to the first material can comprise a second material, wherein the first material and the second material differ from one another by a property selected from the group consisting of modulus of elasticity, chemical composition, Shore A hardness, color, and combinations thereof. Shore A Hardness is measured following ASTM D2240 on a material of the same composition as the material being evaluated. A cap 10 comprising first surface irregularities 150 comprised of a first material and another portion of the cap 10 next to the first material comprising a second material can be formed by a two shot injection molding process, with the first material and the second material delivered to the mold in separate shots. In one embodiment, the first material can comprise polypropylene, rubber, neoprene, and/or KRATON. In one embodiment, the portion of the cap 10 next to the first material can be high density polyethylene, polypropylene, polyamide, styro lacrylintrol. The first surface irregularities can be a elastomeric material.

In one embodiment the first material can have a softer feel to the user than the second material, as might be indicated by a lower Shore A hardness or lower modulus of elasticity. The second material can be selected to provide for acceptable overall structural stability of the cap during packaging, storing, shipping, and display of the detergent composition 300 and during use of the cap 10 by the consumer to pre-treat stains. A more readily deformable first material might provide for scrubbing surface that is gentler on the fabric being treated than a scrubbing surface formed of the second material and may not damage the fabric being treated. The first material can have a Shore A hardness between about 20 and about 80. The first material can have a Shore A hardness of between about 40 and about 60. The first material can have a Shore A hardness that is less than about 80% f the Shore A hardness of a portion of the cap 10 next to the first material.

Providing the first material and the second material in two different colors can help the consumer quickly identify what part of the cap 10 is engineered to be used for scrubbing the stain and might be helpful to vision systems that might be used to position the cap 10 during manufacture and/or assembly of the cap and packaging of the detergent composition 300. Providing the first material and the second material to have different chemical composition can yield a cap 10 for which different parts of the cap 10 are designed to provide for different functions, such as one part of the cap being practical and durable for scrubbing and another part of the cap 10 providing for structural stability.

To provide for a potentially cleaner stain pretreatment process, the cap 10 can be provided with a collector 250 that at least partially surrounds the exterior surface 80 of the vessel wall 60, an example of which is shown in FIG. 1. The collector 250 can at least partially circumscribe or circumscribe the exterior surface of the vessel wall 60. The collector 250 can provide for retaining a volume of detergent composition 300 that might drip from the rim 90 or aperture when the detergent composition 300 is dispensed from the cap 10. A portion of the collector 250 can be spaced apart from the exterior surface 80 of the vessel wall 60. The retaining volume defined by the space in the collector 250 and the exterior surface 80 can be disposed along the hydraulic pathway of flow for detergent composition 300 between the rim 90, weir 160, or aperture, and the connector 130 disposed on the cap 10. The collector 250 can help keep the connector 130 free of detergent composition 300 thereby reducing the probability that the consumer may come into physical contact with the detergent composition 300. The collector 250 can be sized and dimensioned to fit in the opening 112 of the container 110 so that detergent composition 300 caught in the collector drips back into the container 110 when the cap 10 is reaffixed to the container 110 after use as a pre-treatment device.

Figure 2:
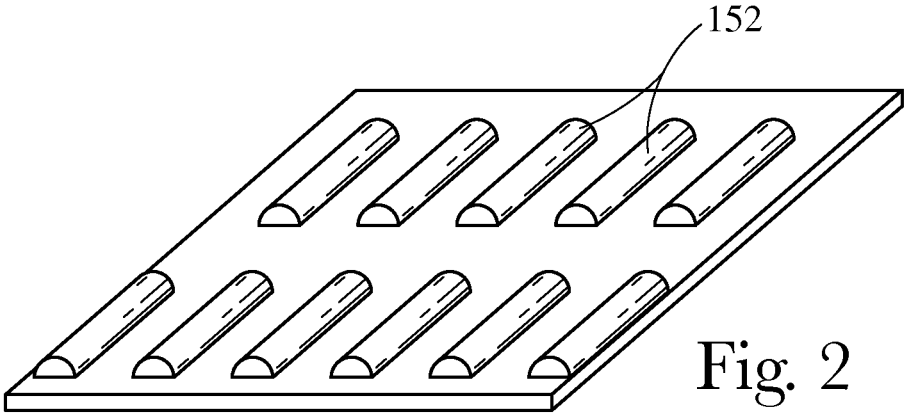
FIG. 2 is a schematic illustrating ribs.

The plurality of first surface irregularities 150 can be structures selected from the group consisting of rings, ribs 152, nubs, bristles, fibers, and combinations thereof. Ribs are a plurality of elongated elevated portions with intermittently disposed elongated recessed portions that are depressed relative to the elevated portions. Ribs 152 can be, for example, a plurality of adjacent grooves etched or molded in substrate and can be a plurality of adjacent ridges. Ribs can be formed in a substrate, for example, by etching a plurality of adjacent grooves in the substrate, by molding the substrate to leave behind a plurality of adjacent grooves, and by molding the substrate to leave behind a plurality of adjacent ridges. An example of a substrate that can form a portion of cap 10 having first surface irregularities 150 and/or second surface irregularities having a plurality of ribs 152 is schematically illustrated in FIG. 2. Ribs 152 can have any desired cross sectional shape including straight edged and rounded. Ribs 152 can be curved along their length. Ribs 152 are thought to provide for a bumpy topography that can effectively scrub and massage the fabric.

Figure 3:
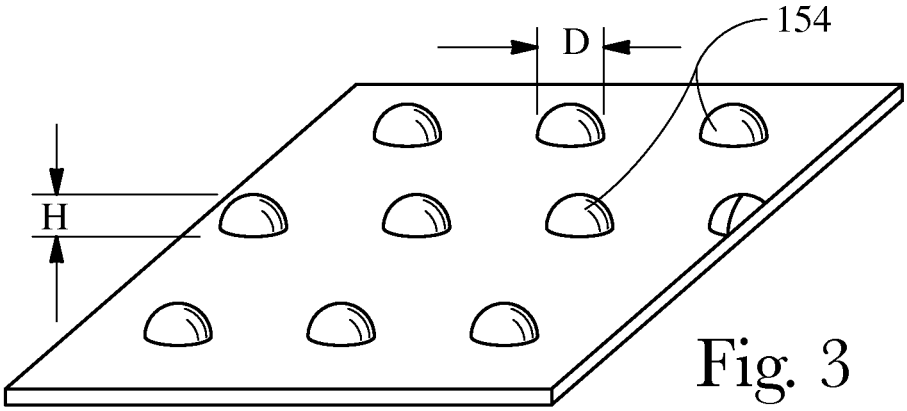
FIG. 3 is a schematic illustrating nubs.

Nubs 154 are generally two-dimensionally symmetric features that are elevated or depressed relative to adjacent portions, an example schematic of which is shown in FIG. 3. Nubs can be, by way of non-limiting examples, elevated portions or depressed portions having a shape of a portion of a hemisphere and elevated portions or depressed portions having a shape of a cylinder having a height H less than half the diameter D. An example of a substrate that can form a portion of cap 10 having first surface irregularities 150 and/or second surface irregularities 155 having a plurality of nubs 154 is schematically illustrated in FIG. 3. Nubs 154 are thought to provide for a bumpy topography that can effectively scrub and massage the fabric.

Figure 4:
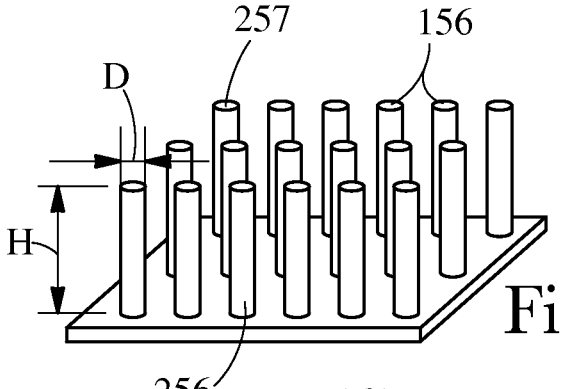
FIG. 4 is a schematic illustrating bristles.

An example of a portion of cap 10 having a plurality of bristles 156 is schematically illustrated in FIG. 4. Bristles 156 are filaments having an aspect ratio of height H to diameter D greater than about 0.5. The diameter D is determined at the base of the bristle which is the location from which the bristle 156 extends from the cap 10. The height H of the bristle 156 is measured orthogonal to the surface from which the base of the bristle 156 extends with the bristle 156 extended orthogonally from the surface from which the base of the bristle 156 extends. Bristles 156 can have a self sustaining shape when extended from the surface from which the base of the bristle 156 extends. For bristles 156 having a non-cylindrical cross section, the diameter D is taken to be the diameter of a cylinder having the same cross-sectional area as the cross-section area of the bristle 156 at the location from which the bristle 156 extends from the cap 10. The filaments can be discrete filaments. Bristles 156 can be filaments having an aspect ratio of height H to diameter D greater than about 1. Bristles 156 can be filaments having an aspect ratio of height H to diameter D greater than about 0.5. Bristles 156 can be generally columnar bristles 156. Bristles 156 are thought to provide for a rough texture/topography that can effectively scrub and massage the fabric. Bristles 156 can be hollow. Bristles 156 can have a fixed end 256 and a free end 257. Bristles 156 can have a height from about 1 mm to about 10 mm. Bristles 156 can have a height from about 3 mm to about 7 mm. Bristles 156 can have a height less than about 7 mm.

Figure 5:
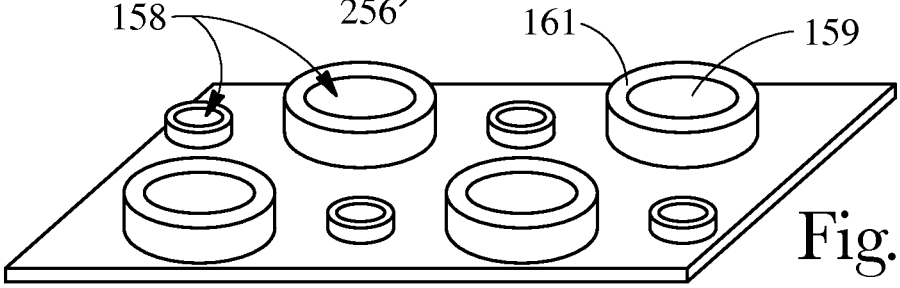
FIG. 5 is a schematic illustrating rings.

Rings 158 are closed shapes in which the central portion 159 of the shape is recessed relative to a peripheral portion 161 of the shape, schematic examples of which are shown n FIG. 5. Rings 158 are thought to be practical in that they provide for a bumpy topography that can effectively scrub and massage the fabric. Rings can have a height between about 0.5 mm to about 3 mm. Rings can have a height less than about 2 mm. Rings can have a height of about 1.5 mm.

Fibers can be woven, nonwoven, hooked, or looped fibers, for example, and be provided for instance by a woven or nonwoven fibrous web being attached to the cap 10 in the desired location. An inexpensive and easily manufactured embodiment of cap 10 can be made by using fibers as the first surface irregularities 150.

Figure 6:
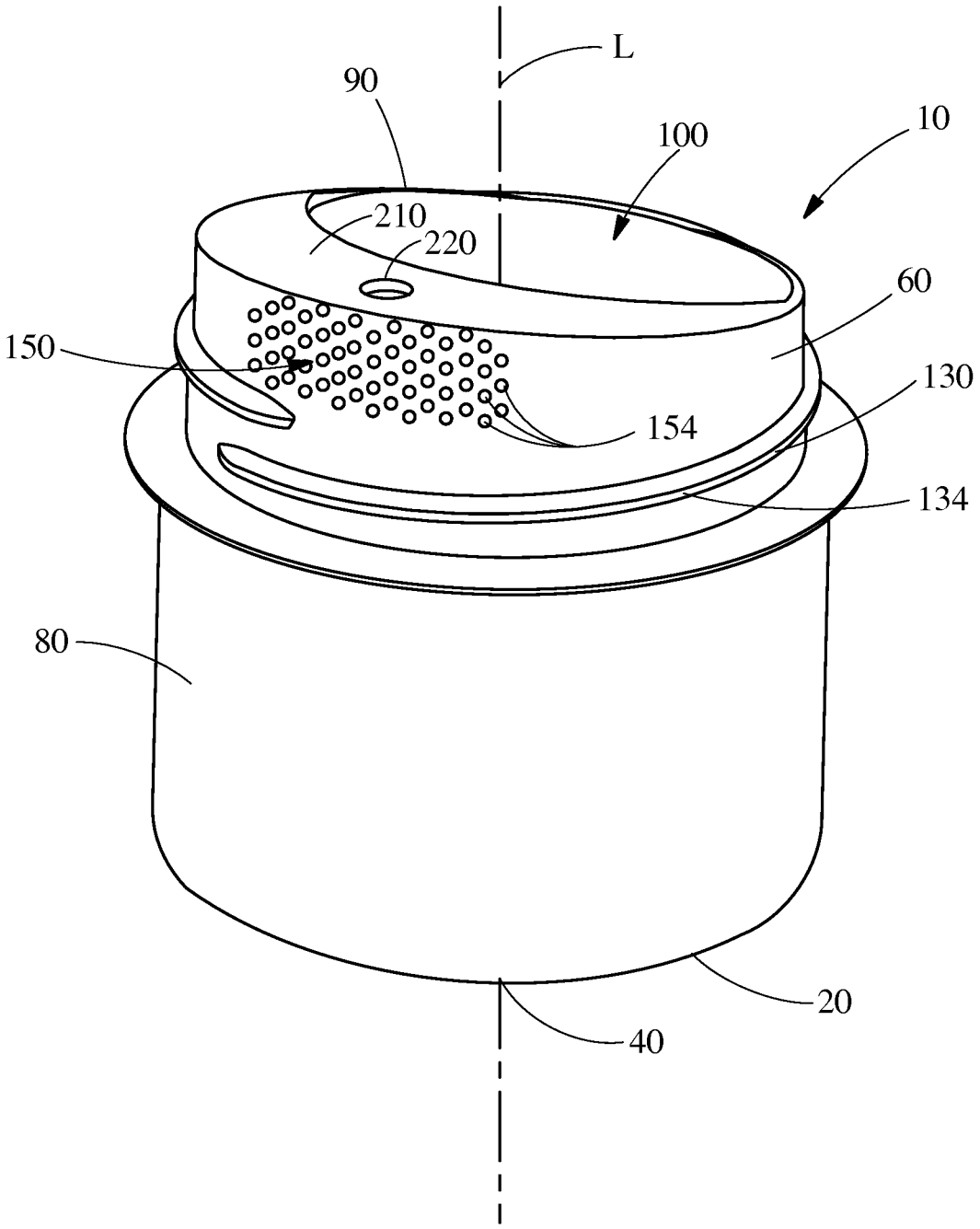
FIG. 6 is a schematic of a cap having a pouring ledge, aperture, and first surface irregularities.

A cap 10 providing for enhanced restrictive pouring of small volumes of detergent composition 300 is also contemplated. For instance, the cap 10 may be provided with a pouring ledge 210 having an aperture 220 there through extending from the vessel wall 60 or rim 90, an example of which is shown in FIG. 6. The aperture 220 can provide for a discrete and precise pour.

The aperture 220 can be generally aligned with the first surface irregularities 150. In such an embodiment, by generally aligned it is meant that the aperture 220 and first surface irregularities are at least within about 0.25π radians of one another about the longitudinal axis L.

As illustrated in FIG. 6, the pouring ledge 210 can extend from the vessel wall 60 or rim 90 back towards the longitudinal axis L. When the cap 10 is slightly tipped to initiate pouring a small volume of detergent composition 300 onto the stained fabric, the pouring ledge 210 can help the consumer limit the amount of detergent composition 300 applied to the stained fabric by allowing the detergent composition 300 to be dispensed from the cap 10 through the aperture 220. Once the proper amount of detergent composition 300 is applied to the stained fabric, the detergent composition 300 remaining in the cap 10 can be dosed to the washing machine by further tipping the cap 10 over the washing machine and allowing the detergent composition 300 to be completely poured from the cap 10. For added convenience, the aperture 220 can be generally aligned with the first surface irregularities 150 so that the user doses not have to reposition the cap 10 in her hand to initiate scrubbing of the stained fabric with the first surface irregularities 150.

Figure 7:
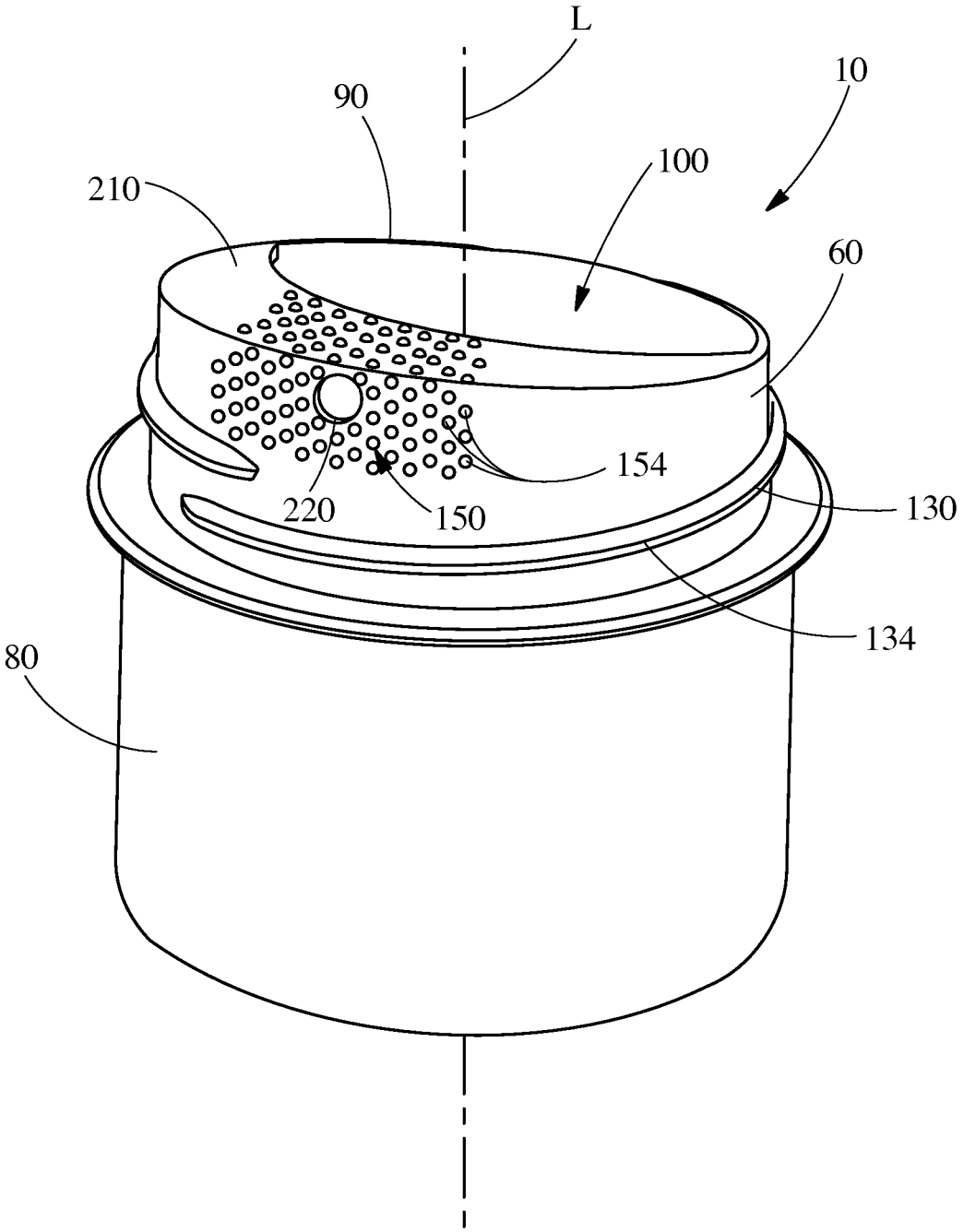
FIG. 7 is a schematic of a cap having a pouring ledge, aperture, and first surface irregularities.

In another alternative arrangement as illustrated in FIG. 7, the pouring ledge 210 can extend from the vessel wall 60 or rim 90 and an aperture 220 is in the vessel wall 60 between the pouring ledge 210 and the base 20 and the aperture 220 is generally aligned with the first surface irregularities 150. In such an embodiment, by generally aligned it is meant that the aperture 220 and first surface irregularities 150 are at least within about 0.25π radians of one another about the longitudinal axis L.

The pouring ledge 210 can be sized, dimensioned, and arranged to provide for a restriction of flow of detergent composition 300 when a small pour of detergent composition 300 is being made by the consumer. A portion of the pouring ledge 210 can extend back from the vessel wall 60 or rim 90 towards the longitudinal axis L and be in a plane orthogonal to the longitudinal axis L. A portion of the pouring ledge 210 can extend back from the vessel wall 60 or rim 90 in a plane within about plus or minus 0.5π radians of being orthogonal to the longitudinal axis L. A portion of the pouring ledge 210 may further extend downwards in the pour volume 100 towards the base interior 30. Such a design might provide for improved control of the quantity of detergent composition 300 delivered to the stain during pre-treatment.

Figure 8:
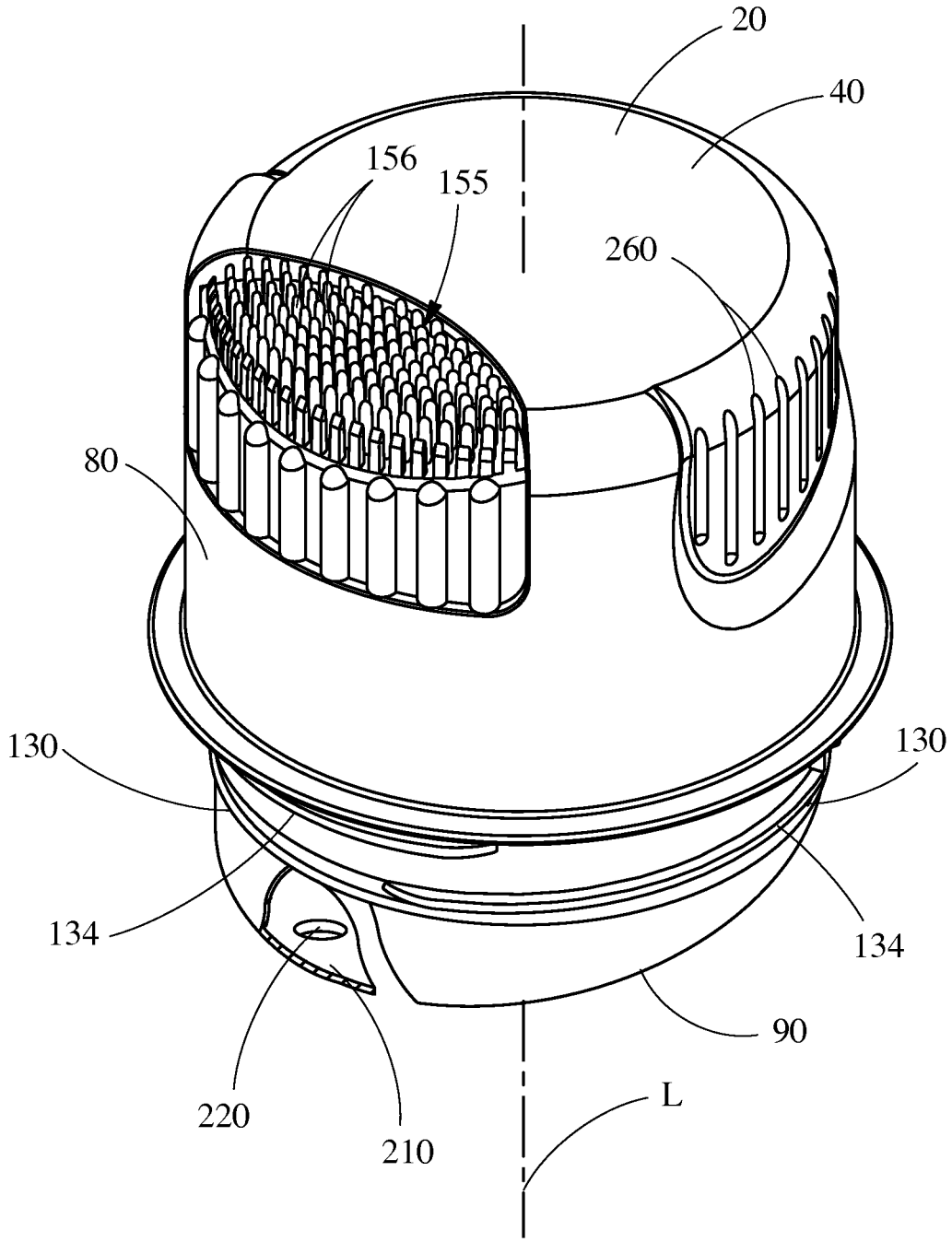
FIG. 8 is a schematic of a cap having second surface irregularities.

Embodiments in which the cap comprises a plurality of second surface irregularities 155 on the outside of the cap 10 such that the connecter 130 is between the rim 90 and the second surface irregularities 155 are also contemplated, as shown in FIG. 8. The cap 10 can have second surface irregularities 155 and not have first surface irregularities 150. The scrubbing surface of the cap can be provided on the outside of the cap such that the connecter 130 is between the rim 90 and the second surface irregularities 155 and possibly not be provided elsewhere on the cap. The cap 10 can comprise a plurality of second surface irregularities 155 at a location selected from the group consisting of on a portion of the base exterior 40, on a portion of the exterior surface 80, and combinations thereof.

The cap 10 can comprise a plurality of second surface irregularities 155 at a location selected from the group consisting of on said base exterior 40 with said second surface irregularities 155 being asymmetrically disposed about the longitudinal axis L, on the exterior surface 80 with the second surface irregularities 155 being asymmetrically disposed about the longitudinal axis L, on the base exterior 40 with the second surface irregularities 155 comprising bristles 156, on the exterior surface 80 with the second surface irregularities 155 comprising bristles 156, and combinations thereof. In such embodiments, the second surface irregularities 155 can be disposed such that the connector 130 is between the rim 90 and the second surface irregularities 155. Second surface irregularities 155 can be any of the structures described above with respect to first surface irregularities 150. The second surface irregularities 155 can be structures selected from the group consisting of rings 158, ribs 152, nubs 154, bristles 156, fibers, and combinations thereof.

By placing the second surface irregularities 155 as such, the second surface irregularities can be located such that after the consumer dispenses a small volume of detergent composition 300 to pre-treat a stain, the second surface irregularities 155 are located such the that user does not have to reposition the cap 10 in her hand or significantly move her hand to be able to position the second surface irregularities 155 in an appropriate position to be rubbed against the stain.

The second surface irregularities 155 can comprise a first material and another portion of the cap 10 next to the first material can comprise a second material, wherein the first material and the second material differ from one another by a property selected from the group consisting of modulus of elasticity, chemical composition, color, Shore A hardness, and combinations thereof. Such an arrangement can be provided in the same manner and for the same reasons as described above for a cap 10 in which the first surface irregularities 155 are formed from a different material than another portion of the cap 10.

Embodiments in which the second surface irregularities 155 are asymmetrically disposed about the longitudinal axis L can help the consumer identify what portion of the cap 10 is provided for scrubbing the stain during pre-treatment. By asymmetrically disposed, it is meant that such asymmetrically disposed second surface irregularities 155 are disposed such that the second surface irregularities 155 on the exterior surface 80 or base exterior 40 are not balanced about a single location, such as a point on the longitudinal axis L or other point. The cap can 10 can comprise a plurality of gripping irregularities 260 on the exterior surface 80 and/or base exterior 40 and the gripping irregularities 260 can be uniformly distributed about a location to provide structures that help the consumer grip the cap when removing the cap 10 from the container 110. The gripping irregularities 260 may be symmetrically distributed on the exterior surface 80 and/or base exterior 40 about a location so as to have one-fold symmetry, for example a fold passing through a point on the longitudinal axis L.

The second surface irregularities 155 can be comprised of a first material and the gripping irregularities 260 can be comprised of a second material, wherein the first material differs from the second material by a property selected from the group consisting of modulus of elasticity, chemical composition, color, Shore A hardness, and combinations thereof. Such an arrangement can help the user identify the portion of the cap 10 that is designed to be used as a scrubbing implement.

The cap 10 can be a cap 10 wherein a pouring ledge 210 having an aperture 220 there through extends from the vessel wall 60 or rim 90 and the aperture 220 is generally aligned with the second surface irregularities 155 or wherein a pouring ledge 210 extends from the vessel wall 60 or rim 90 and an aperture 220 is in the vessel wall 60 between the pouring ledge 210 and the base 20 and the aperture 220 is generally aligned with the second surface irregularities 155. An illustration of aspects of such an embodiment is shown in FIG. 8.

Figure 9:
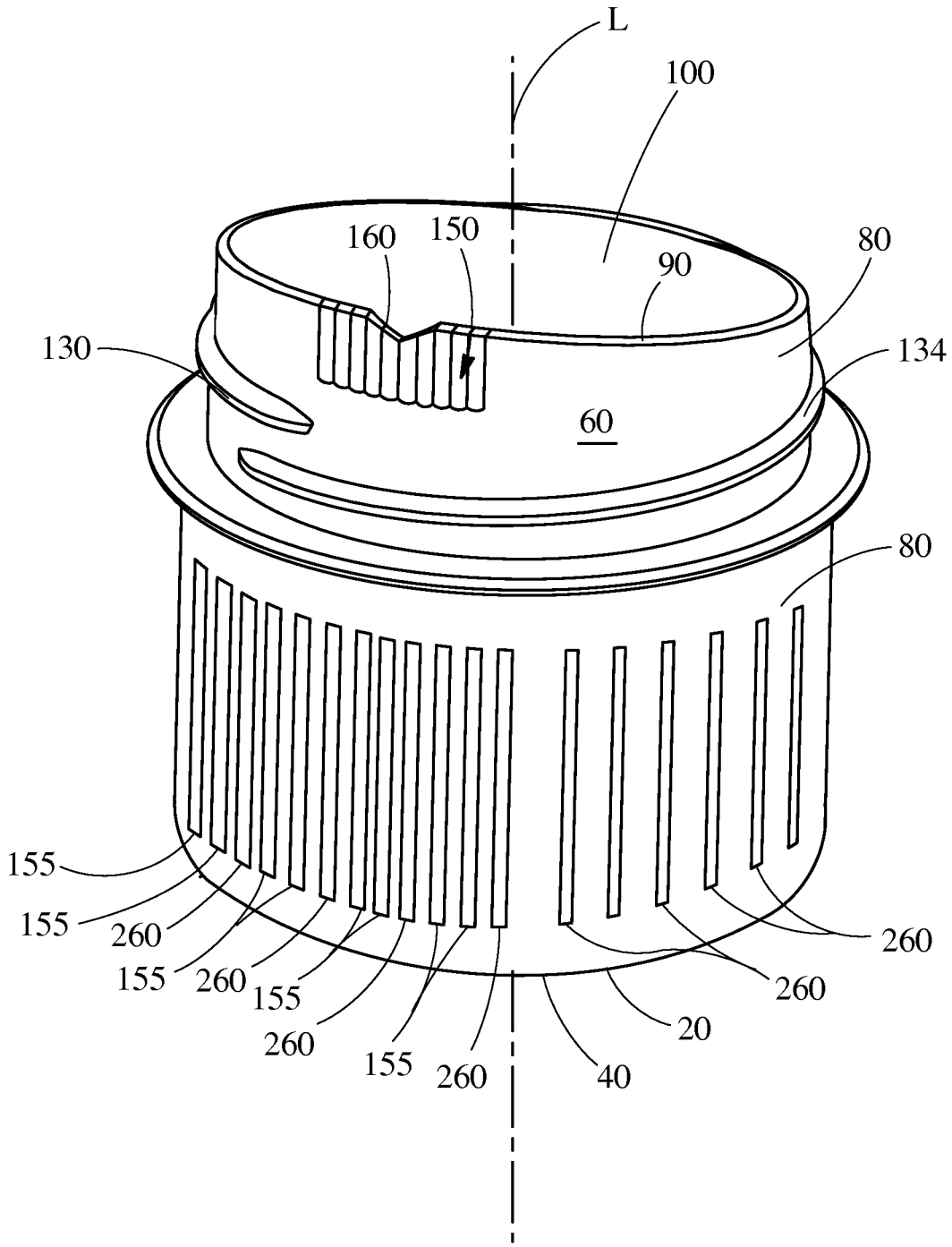
FIG. 9 is a schematic of a cap having second surface irregularities.

As shown in FIG. 9, the rim 90 can have a weir 160 and the weir 160 can be generally aligned with the second surface irregularities 155. In such an embodiment, by generally aligned it is meant that the weir 160 and second surface irregularities 155 are at least within about 0.25π radians of one another about the longitudinal axis L. In such an embodiment, as the user tips the cap 10 to deliver a small volume of detergent composition 300 to the stain, the second surface irregularities 155 will naturally be located proximal the stain and the user will be able to easily initiate the scrubbing motion without having to tip the cap 10 further or reposition the cap 10 in her hand.

An embodiment in which the second surface irregularities 155 are ribs 152 is shown in FIG. 9. As shown in FIG. 9, the ribs 152 are asymmetrically disposed about the longitudinal axis L in that the pattern of ribs 152 does not extend all the way around the exterior surface 80. The pattern of gripping irregularities 260 is uniformly distributed about the longitudinal axis L such that the pattern of gripping irregularities 260 extends all the way around the exterior surface 80. As shown in FIG. 9, the second surface irregularities 155 and the first surface irregularities 150, if present, can be generally aligned with one another. In such an embodiment, by generally aligned it is meant that the first surface irregularities 150 and second surface irregularities 155 are at least within about 0.25π radians of one another about the longitudinal axis L. Such an embodiment can provide for giving consumers a choice of which part of the cap they desire to use for scrubbing. Consumers may rather use the second surface irregularities 155 if there is some volume of detergent composition 300 left in the cap 10. Consumers might choose between first surface irregularities 150 and second surface irregularities 155 based on efficacy for different types of stains.

If the cap 10 has both first surface irregularities 150 and second surface irregularities 155, the second surface irregularities 155 can be substantially identical in physical structure to the first surface irregularities 150. In such an embodiment, by substantially identical it is meant that the first surface irregularities 150 and second surface irregularities 155 have the same geometric characteristics or differ, if at all, only in scale or dimension. For instance, if the second surface irregularities 155 are nubs 154 then the first surface irregularities can also be nubs 154. The nubs 154 in each location may have the same geometric characteristics or differ only in scale or dimension of the nubs 154. In one embodiment, the second surface irregularities 155 can be ribs 152 and the first surface irregularities 150 can also be ribs 152. Such embodiments might provide for designs in which the first surface irregularities 150 are obscured from view when the cap 10 is engaged with the container 110 when the container 110 is on display at a retailer. Since the second surface irregularities 155 are visible to the consumer in this condition, the second surface irregularities 155 can provide an indicator to the consumer of what the obscured first surface irregularities 150 look like without the consumer having to open the package. This can be important when the container 110 is on display at a retailer because consumers might desire to open the container 110 prior to purchase to see if the cap 10 is provided with the first surface irregularities 150. Embodiments in which the second surface irregularities 155 can be selected from the group consisting of rings 158, ribs 152, nubs 154, bristles 156, fibers, and combinations thereof, are contemplated.

For second surface irregularities 155 that are bristles 156, bristles 156 can be formed such that the bristles are generally aligned parallel to the longitudinal axis, as for instance shown in FIG. 8, or generally aligned orthogonal to the longitudinal axis L. In such an arrangement, when the second surface irregularities 155 are scrubbed against the stained fabric, the cap 10 is likely to be tilted. Thus, as the user scrubs with the cap, a combination of normal forces and shear forces can be delivered to the stained fabric and the bristles 156 may tend to bend thereby creating an effective brushing movement of the individual bristles 156.

The bristles 156, if present as second surface irregularities 155, can be set such that the bristles 156 are nested with the maximum radial extent of the exterior surface 80 of the cap 10 from the longitudinal axis L. Such an arrangement can protect the bristles 156 from damage during transport, storage, and use. For a similar benefit, the bristles 156 can be set such that the bristles 156 are nested within the maximum axial extent along the longitudinal axis L.

Figure 10:
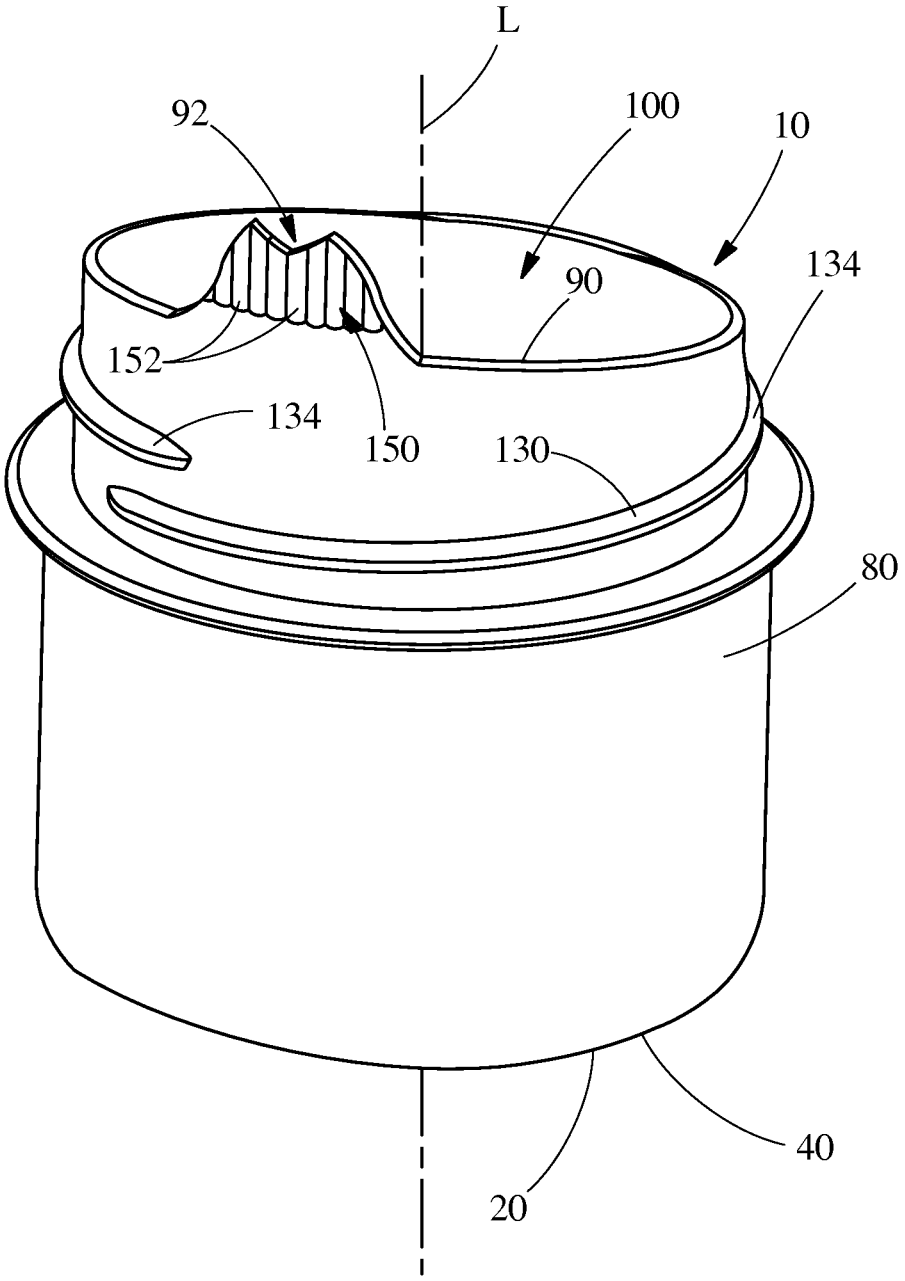
FIG. 10 is a schematic of a cap having a spout.

An example of a cap 10 in which the rim 90 has the shape of a spout 92 is illustrated in FIG. 10. A cap 10 in which the rim 90 has the shape of a spout 92 can be practical for providing for a precise pour of a small volume of detergent composition 300 to a stained fabric and to help keep a large volume of detergent composition 300 from being accidentally dispensed during pre-treatment of a stain. A variety of spout 92 geometries can be practical, particularly those geometries which tend to tightly channel liquid flow.

A plurality of first surface irregularities 150 can be provided at the tip of the spout 92. First surface irregularities 150 can be advantageously placed as such so that once the small volume of detergent composition 300 is poured onto the stain, the cap 10 is positioned in the user's hand such that the first surface irregularities 150 can be conveniently rubbed against the stain. Further, if the user only places a small volume of detergent composition 300 in the pour volume 100 and tips the cap 10 nearly completely over when she pre-treats the stain, the spout 92 can still be visible to the user and she will be able to see the first surface irregularities 150 and observe her scrubbing of the stain. Without a spout 92, the portion of the rim 90 located opposite of the side from which the detergent composition 300 is dispensed might obstruct her view of the first surface irregularities 150 and her scrubbing of the stain. Further, since the consumer may tend to pour from the cap 10 such that the flow emanates from a location on the rim 90 between her index finger and thumb as she rotates her wrist, the first surface irregularities 150 can be located such that these features might be conveniently and ergonomically located for the consumer to exploit these features. For instance, the cap 10 can comprise a plurality of first surface irregularities 150 at a location selected from the group consisting of on the rim 90, between the connecter 130 disposed on the cap 10 and the rim 90, and combinations thereof.

Figure 11:
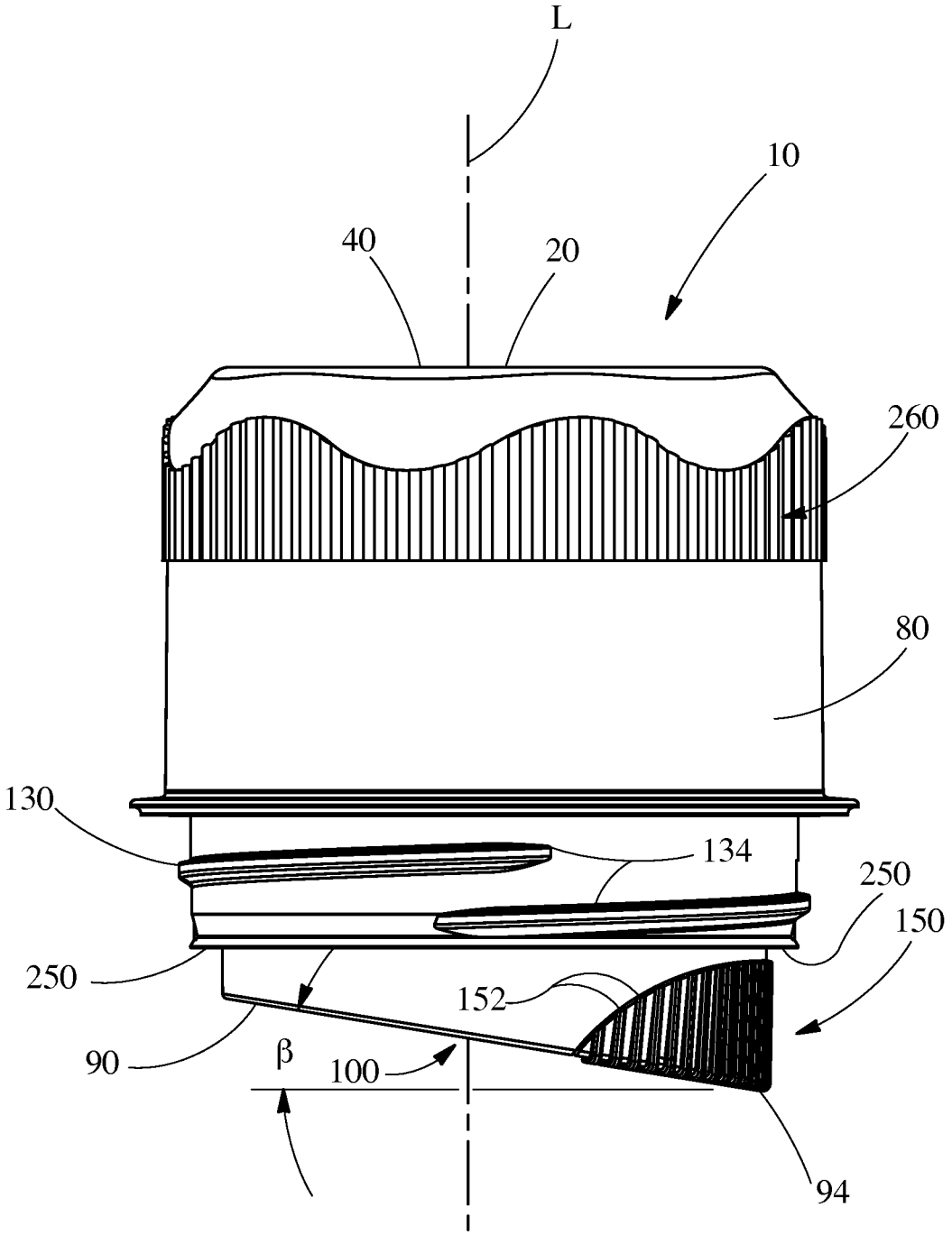
FIG. 11 is a schematic of a cap having a spout.

One example design for a practical spout 92 can be a cylindric section, as illustrated in FIG. 11. A spout 92 having the shape of a cylindric segment can be structurally stable so that an unacceptable amount of deformation of the rim 90 does not occur during scrubbing of the stain. Further, after filling the pour volume 100 of the cap 10 with detergent composition 300, the user may tend to try to keep the phreatic surface of the detergent composition 300 level with the ground. When the phreatic surface of the detergent composition 300 in the pour volume 100 is kept level, the profile view of the cap 10 will present an angled rim 90 to the viewer. The consumer expectation for dosing devices, such as caps or cups, might be that the rim 90 of the cap should be level with the ground, for instance as might be the case for caps that have a cylindrical pour volume 100. Thus, when applying the detergent composition 300 to pre-treat a stain, the consumer might naturally and intuitively attempt to level the rim 90 of the cap as she pours out the detergent composition 300 from the cap 10. A consumer may tend to pour from the cap 10 such that the flow emanates from a location between her index finger and thumb as she rotates her wrist. With these insights, designers might be able to have a significant influence on what portion of the rim 90 that a consumer will choose to pour from. By driving the consumer to pour from a certain portion of the rim 90, designers can coordinate the location of other features on the cap, for example first surface irregularities 150, second surface irregularities 155, aperture 220, pouring ledge 210, weir 160, and collector 250, such that these features might be conveniently and ergonomically located to allow the user to exploit these features without having to reposition the cap 10 in her hand.

In one example embodiment, the rim 90 can be parallel to a plane oriented at an angle β more than about five degrees out of plane with respect to the base exterior 40. In one example embodiment, the rim 90 can be parallel to a plane oriented at an angle β more than about ten degrees out of plane with respect to the base exterior 40. In one example embodiment, the rim 90 can be parallel to a plane oriented at an angle β more than about fifteen degrees out of plane with respect to the base exterior 40.

The rim 90 can have an apex 94, which is the highest portion of the rim 90 when the cap 10 positioned on a flat surface such that detergent composition 300 can be poured into the pour volume 100. The rim 90 can be provided with a weir 160. In one embodiment, the rim 90 can be parallel to a plane oriented at an angle β more than about five degrees out of plane with respect to the base exterior 40 and the rim can have an apex 94 relative to the base exterior 40 and the cap 10 can comprise a plurality of first surface irregularities 150 on the rim 90.

Figure 12:
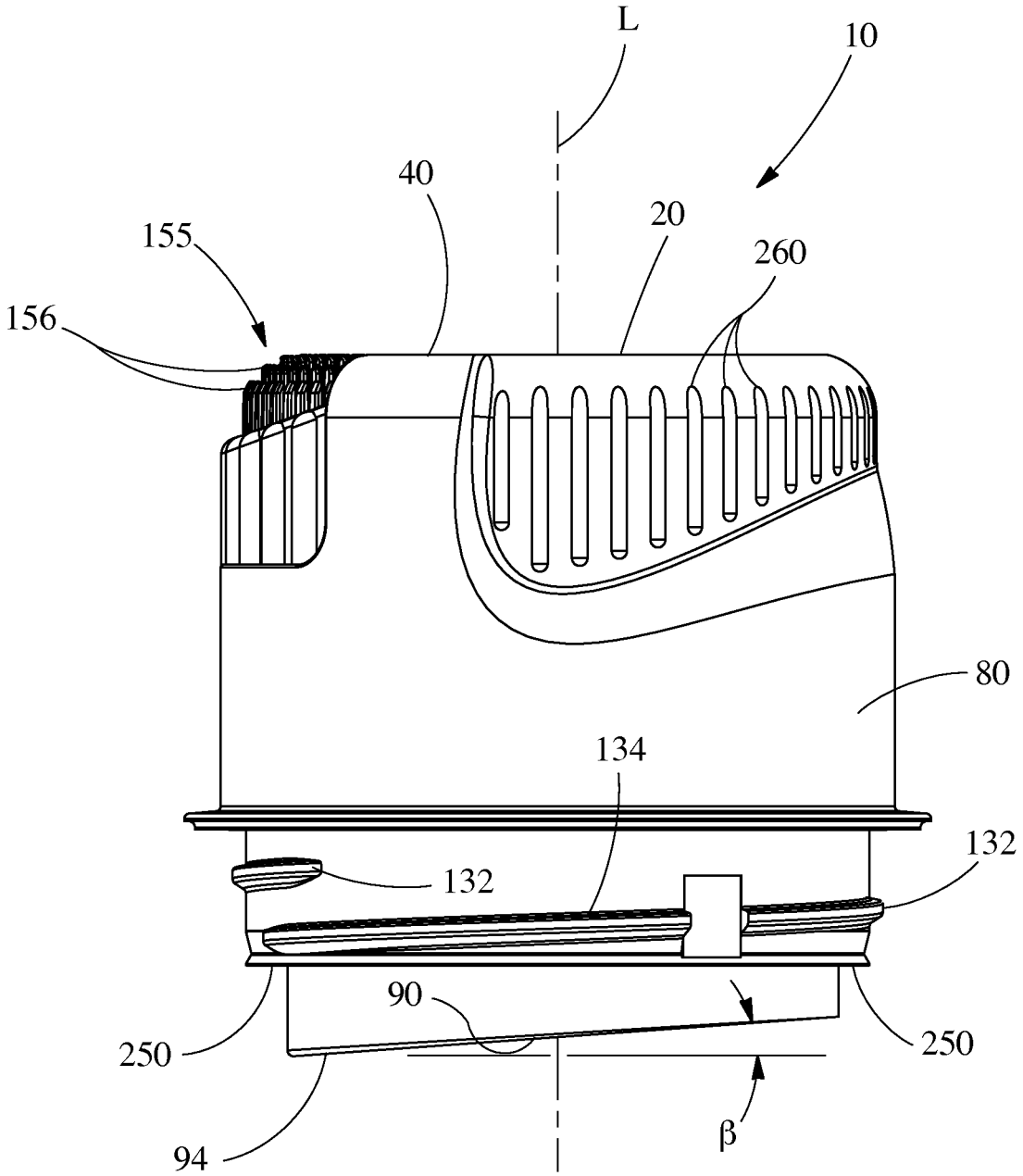
FIG. 12 is a schematic of a cap having second surface irregularities and a spout.

A cap 10 having a spout 92 can have a plurality of second surface irregularities 155 on a portion of the base exterior 40 or a portion of the exterior surface 80, an example of which is shown in FIG. 12. In one example embodiment, the apex 94 and the second surface irregularities 155 are generally aligned with one another. In such an embodiment, by generally aligned, it is meant that the apex 94 and the second surface irregularities 155 are at least within about 0.25π radians of one another about the longitudinal axis L. In one embodiment, the rim 90 can have a weir 160 at the apex 94 and the apex 94 and the second surface irregularities 155 can be generally aligned with one another. In such embodiments, by generally aligned, it is meant that the apex 94 and the second surface irregularities 155 are at least within about 0.25π radians of one another about the longitudinal axis L. In embodiments having such second surface irregularities 155, by coordinating the location of the second surface irregularities 155 with the apex 94, and weir 160 if present, when the consumer finishes pouring the detergent composition 300 to pre-treat the stain, the second surface irregularities 155 can be in the proper position for the consumer to scrub the stain with the second surface irregularities 155 without her having to reposition the cap 10 in her hand. After pouring, she will likely be holding the cap 10 in an upright position with the second surface irregularities 155 located proximal to the stained fabric.

Figure 13:
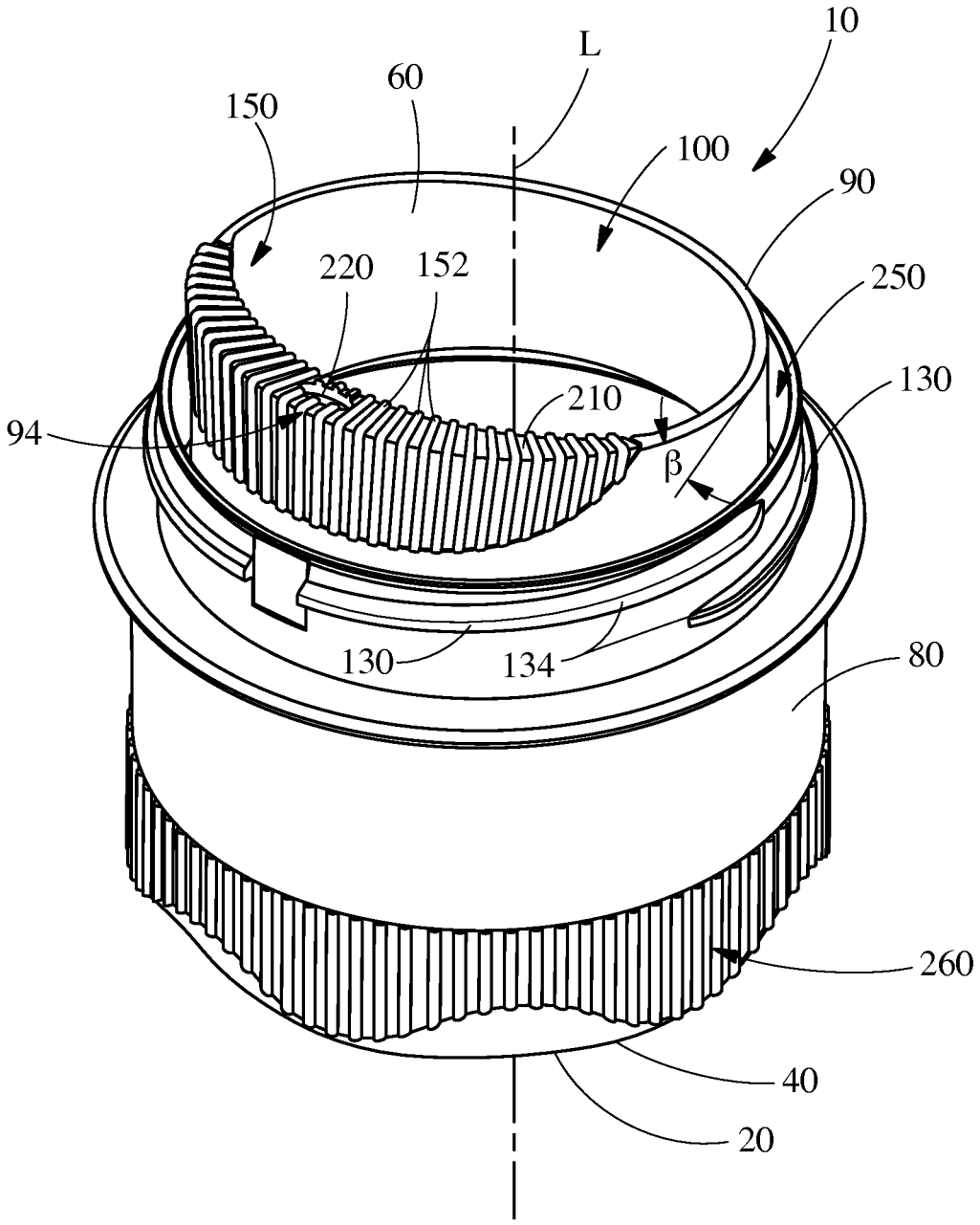
FIG. 13 is a schematic of a cap having first surface irregularities, a pouring ledge, an aperture, and an apex.

An example embodiment in which a pouring ledge 210 having an aperture 220 there through extends from the rim 90, the rim 90 having an apex 94 relative to the base exterior 40 and the aperture 220 is generally aligned with the apex 94 is shown in FIG. 13. As disclosed above, the pouring ledge 210 can extend from, for example, the vessel wall 60 or rim 90. Further, as disclosed above, the aperture 220 can be in the vessel wall 60 between the pouring ledge 210 and the base 20, the aperture 220 being closer to the pouring ledge 210 than the base 20. In these embodiments, by generally aligned, it is meant that the aperture 220 and the apex 94 are at least within about 0.25π radians of one another about the longitudinal axis L. Various combinations of these features can provide the desired benefit and can be described as a cap 10 wherein a pouring ledge 210 having an aperture 220 there through extends from the vessel wall 60 or rim 90 and the rim 90 has an apex 94 relative to the base exterior 40 and the aperture 220 is generally aligned with the apex 94 or, in an another embodiment, wherein a pouring ledge 210 extends from the vessel wall 60 or rim 90 and an aperture 220 is in the vessel wall 60 between the pouring ledge 210 and the base 20 and the aperture 220 is closer to the pouring ledge 210 than the base 20.

A cap 10 having various combinations of the features disclosed herein can provide an effective stain pre-treatment device. A cap 10 can be provided with first surface irregularities 150 at any of the locations or combinations of locations described above. A cap 10 can be provided with second surface irregularities 155 at any of the locations or combinations of locations described above. A cap 10 can be provided with first surface irregularities 150 and second surface irregularities 155, each of which are located at the locations or combinations of locations for second surface irregularities 155 described above. Various embodiments can be provided with a pouring spout 92 as described above to provide for more precise pouring. Such pouring spout 92 can be a cylindric section. Each of the embodiments contemplated herein can be provided with a pouring ledge 210 having an aperture 220 there through, as described above. Each of the embodiments contemplated herein can be provided with a collector 250. Embodiments contemplated herein can be provided with a weir 160 in the rim 90 to provide for precise pouring. The features of the cap 10 can be located relative to one another as described for the embodiments above.

A cap 10 may be used in a method of pre-treating a clothing article having a stained portion. The method can comprise the steps of removing a cap 10 from a container containing a detergent; pouring or dispensing a volume of the detergent composition 300 from the container 110 into the cap 10; applying at least a portion of the volume of the detergent composition 300 to a stained portion of the stained clothing article; scrubbing the stained portion with a portion of the cap 10; reengaging the cap 10 with the container 110 containing the detergent composition 300. The step of scrubbing the stained portion with a portion of the cap 10 can be performed with a portion of the cap 10 selected from the group consisting of the rim 90 of the cap 10, a portion of the cap 10 between the rim 90 and the connector 130, the exterior surface 80, the base exterior 40 of the cap 10, and combinations thereof. The cap 10 used in the method can be any of the various embodiments and combinations of embodiments of the cap 10 contemplated herein. The cap 10 can be removed from a container 110 by unscrewing the cap 10 to disengage threads 134 on the cap 10 from corresponding threads 134 located on the container 110. The cap 10 can be reengaged with the container 110 by screwing the cap 10 to engage threads 134 on the cap 10 with threads 134 located on the container 110. The cap 10 can have a spout 92. The spout 92 can be a cylindric section. The volume detergent composition 300 poured into the cap 10 can be a unit dose of the detergent composition 300. The method can comprise a step of placing the cap 10 in the drum of a washing machine. In such an approach, detergent composition 300 remaining in the cap 10 after pre-treatment of a stain can be delivered to the wash.

The color of the first material and second material are measured by the reflectance spectrophotometer according to the colors L*, a*, and b* values.

The color difference is calculated using the L*, a*, and b* values by the formula $\Delta E=[(L^*_X-L^*_Y)^2+(a^*_X-a^*_Y)^2+(b^*_X-b^*_Y)^2]^{1/2}$. Herein, the 'X' in the equation represents the first material and 'Y' represents the second material, X and Y cannot be the same two points of measurement at the same time. For any particular comparison of the difference in color, the location of X≠the location of Y.

Reflectance color is measured using the Hunter Lab LabScan XE reflectance spectrophotometer obtained from Hunter Associates Laboratory of Reston, Va. A cap 10 is tested at an ambient temperature between 65° F. and 75° F. and a relative humidity between 50% and 80%.

The spectrophotometer is set to the CIELab color scale and with a D65 illumination. The Observer is set at 10° and the Mode is set at 45/0°. Area View is set to 0.125" and Port Size is set to 0.20". The spectrophotometer is calibrated prior to sample analysis utilizing the black glass and white reference tiles supplied from the vendor with the instrument. Calibration is done according to the manufacturer's instructions as set forth in LabScan XE User's Manual, Manual Version 1.1, August 2001, A60-1010-862. If cleaning is required of the reference tiles or samples, only tissues that do not contain embossing, lotion, or brighteners should be used (e.g., PUFFS tissue). Any sample point on the cap containing the color to be analyzed can be selected.

The cap 10 is placed over the sample port of the spectrophotometer with a white clamp disk placed behind the cap 10.

The cap 10 is removed and repositioned so that a minimum of six readings of color of the cap 10 are conducted. If possible (e.g., the size of the imparted color on the element in question does not limit the ability to have six discretely different, non-overlapping sample points), each of the readings is to be performed at a substantially different region on the externally visible surface so that no two sample points overlap. If the size of the portion of the cap comprising the first material or second material requires overlapping of sample points, only six samples should be taken with the sample points selected to minimize overlap between any two sample points. The readings are averaged to yield the reported L*, a*, and b* values for a specified color on an externally visible surface of an element.

The first material and second material are considered to have different colors if ΔE is greater than about 1.

Figure 14:
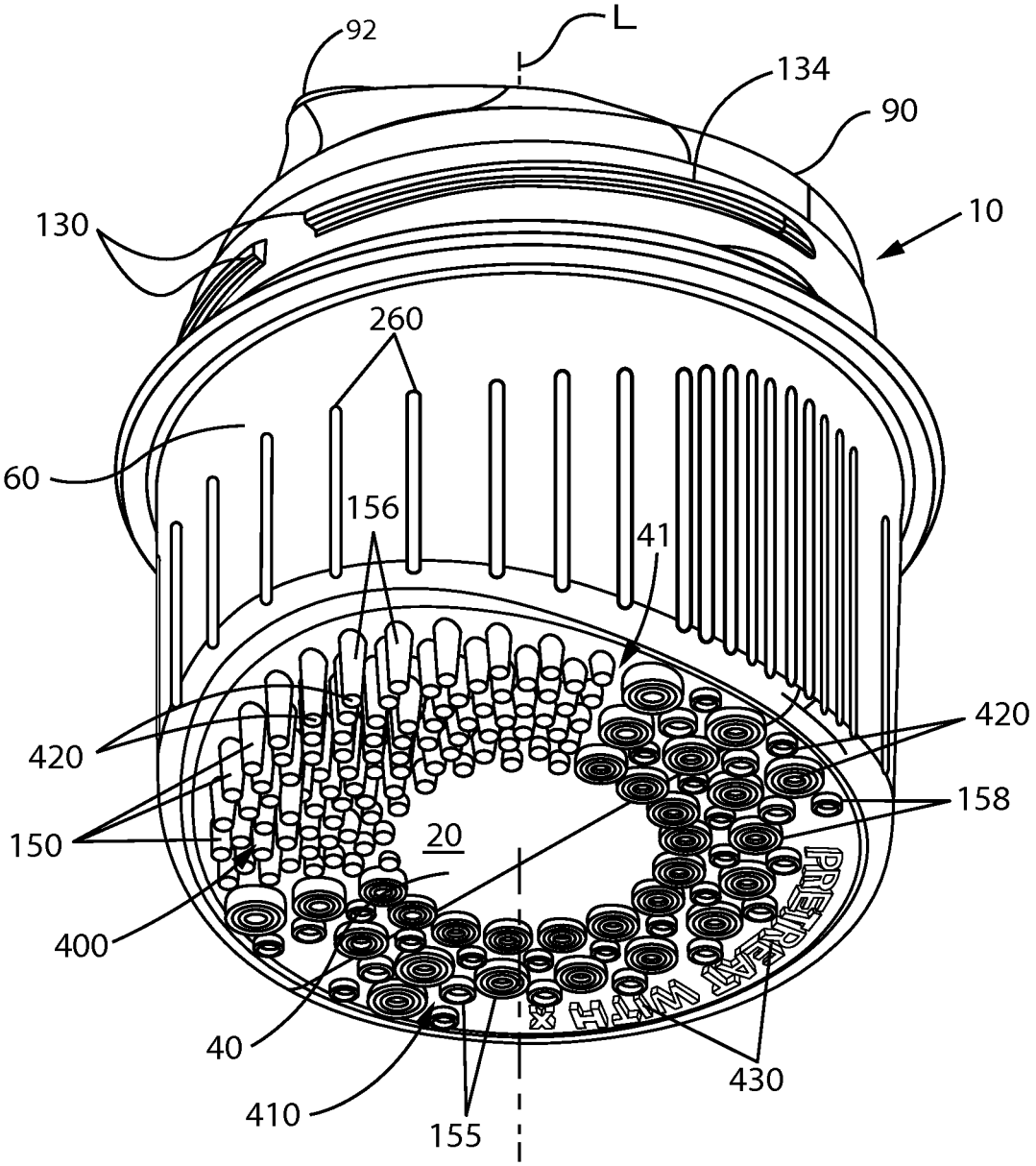
FIG. 14 is a schematic of a cap having a first region and a second region on the base exterior.

An embodiment in which the cap 10 comprises two regions of surface irregularities on the base exterior 40 is shown in FIG. 14. The base exterior 40 can have a first region 400 and a second region 410 disposed thereon. The second region 410 can be adjacent to the first region 400. The first region 400 can comprise a plurality of first surface irregularities 150 and the second region 410 can comprise a plurality of second surface irregularities 155. Each region of surface irregularity can provide for a different benefit. For instance, the first surface irregularities 150 can provide for a scrubber that can be used to scrub a stain on a fabric or article of clothing. Second surface irregularities 155 can provide for a spreader that can spread a detergent composition 300 over such a stain or provide for a roughened surface to disrupt the boundary layer of detergent composition 300 that might develop when scrubbing the stain with first surface irregularities 150.

For a cap 10 that has only first surface irregularities 150 on the base exterior 40 or on the vessel wall 60 proximal the base exterior 40, it is possible that some consumers might use a cap 10 as disclosed herein by choosing to scrub the stain with the base exterior 40 facing the stain such that the first surface irregularities 150 and the remainder of the base exterior 40 face the stain. That is, the cap 10 may be in position that is essentially the same as the position a consumer puts the cap 10 in when she is filling the pour volume 100 with a unit dose of detergent composition 300. If the portion of the base exterior 40 that does not comprise first surface irregularities 150 is generally smooth, that portion of the base exterior 40 may glide over the detergent composition 300 much like a person glides on a thin layer of water when they slide down a recreational waterslide or slip on a smooth wet floor. Such a result may not be desirable if the thin layer of detergent 300 that forms the boundary layer between the fabric being treated and the cap 10 is thick enough to maintain separation or reduce contact (no direct contact) between the first surface irregularities 150 and the fabric being treated. Thick high density liquids such as modern liquid detergent formulations that have high viscosity may form an appreciable boundary layer when vigorously sheared, as might occur during scrubbing. If such a fluid dynamic occurs, the first surface irregularities 150 may not contact the stain being treated and the cap 10 may glide around the stained fabric and the stained fabric may offer little frictional resistance. A user can mitigate this concern if the cap 10 is slightly tipped such that only, or mostly only, first surface irregularities 150 contact the stain being treated or tipping the cap 10 enough such that a boundary layer of fluid does not develop upon which the cap 10 can glide.

The first surface irregularities 150 can differ in shape from the second surface irregularities 155. The shape may be different so as to provide for a different benefit in that one shape provides for scrubbing and the other provides for disrupting development of a boundary layer of detergent composition 300. Such a difference in shape can also be helpful to drive the consumer to recognize that different regions of the base exterior 40 of the cap may be present to provide for different functions and to select the proper region to scrub the stain with.

The first surface irregularities 150 can differ in shape from the second surface irregularities 155 by properties including, but not limited to, height, diameter, aspect ratio, curvature of various surfaces. For instance, first surface irregularities 150 can be generally columnar shaped and second surface irregularities can be a disordered roughened texture.

The apexes 420 of a plurality of first surface irregularities 150 can be in plane with the apexes 420 of a plurality of second surface irregularities 155. Such an arrangement might be practical for providing a cap 10 that can be stably set on a surface such that detergent composition 300 can be poured into the pour volume 100. The pour volume 100 can have a phreatic surface when filled with detergent composition 300 wherein the apexes 420 of the plurality of first surface irregularities 150 and the apexes of the plurality of second surface irregularities 155 are parallel or substantially parallel with the phreatic surface. The phreatic surface is the free surface of the detergent composition 300 when poured into the pour volume 100.

For high density liquid detergent compositions 300, the pour volume 100 can be sized and dimensioned to provide for a pour volume 100 that is between about 10 mL and about 200 mL. Depending on the compactness of the high density liquid detergent composition 300, the pour volume 100 can be sized and dimensioned to provide for a pour volume 100 that is between about 30 mL and about 100 mL. Depending on the compactness of the high density liquid detergent composition 300, the pour volume 100 can be sized and dimensioned to provide for a pour volume 100 that is between about 45 mL and about 77 mL. The vessel wall 60 can define a radial perimeter about the longitudinal axis L of about 225 mm. The vessel wall 60 can have a height of about 67 mm.

The first surface irregularities 150 can comprise a thermoplastic elastomer. The second surface irregularities 155 can comprises a thermoplastic elastomer. The first surface irregularities 150 and second surface irregularities 155 can comprise a thermoplastic elastomer. Employing a thermoplastic elastomer for first surface irregularities 150 and/or second surface irregularities 155 can be advantageous because thermoplastic elastomers may be gentler on fabrics when rubbed against a fabric being treated, as opposed to thermoset material. A thermoplastic elastomer can form surface irregularities selected from the group consisting of said first surface irregularities, said second surface irregularities, and combinations thereof.

The first surface irregularities 150, the second surface irregularities 155, and both the first surface irregularities 150 and the second surface irregularities 155 can be acrylonitrile butadiene styrene. The vessel wall 60 and/or the base 20 may be comprised of a thermoset material in the embodiments described herein. The vessel wall 60 and/or base 20 may be comprised of acrylonitrile butadiene styrene. The vessel wall 60 and/or base 20 may be comprised of polypropylene. The vessel wall 60 and/or base 20 can be comprised of the material used in caps of packaging of TIDE liquid detergent, manufactured by The Procter & Gamble Co., Cincinnati, Ohio. The vessel wall and/or base 20 may be comprised of Flinthills AP5520HA available from Flint Hills Resources, LP, Wichita, Kans., U.S.A.

If the vessel wall 60 and/or base 20 is polypropylene and a thermoplastic elastomer is used for either or both of the first surface irregularities 150 and/or the second surface irregularities 155, the thermoplastic elastomer can be selected such that it is of the type that is compatible with polypropylene. In one embodiment in which a thermoplastic elastomer is employed, the thermoplastic elastomer used for surface irregularities selected from the group consisting of first surface irregularities 150, second surface irregularities, and combinations thereof, the thermoplastic elastomer can be VERSAFLEX 9500, available from GLS Thermoplastic Elastomers, McHenry, Ill., U.S.A.

It can be practical to a have a cap 10 wherein the first surface irregularities 150 and the vessel wall 60 comprise materials having different chemical compositions from one another so as to provide different benefits with different portions of the cap 10 and/or to cost-optimize manufacture of the cap 10. Similarly, it can be practical to have the first surface irregularities 150 and second surface irregularities 155 comprise materials having different chemical composition from one another so as so as to provide different benefits with different portions of the cap 10 and/or to cost-optimize manufacture of the cap 10. For instance the first surface irregularities 155 can be thermoplastic elastomer that provides for a pliable scrubbing surface and second surface irregularities 155 can be a thermoset material that provides for a rugged and rigid topographic profile for disrupting a boundary layer of detergent composition 300 and that is durable.

The vessel wall 60 can comprise a material that has a Shore A hardness greater than that of the first surface irregularities 150 to provide for a rigid vessel wall that is stiff when the consumer grips the cap 10 to remove the cap 10 from the container 110, is stiff enough to withstand installation with the container 110 during production of consumer product, and is stiff enough to withstand shipping and storage.

The base exterior 40 may be non-planar, as shown in FIG. 14. If apexes of the plurality of first surface irregularities 150 are in plane with apexes of a plurality of second surface irregularities 155 and the base exterior 40 is planar, providing for diversity of height of first surface irregularities 150 and/or second surface irregularities 155 can be challenging. Providing for a diversity of height H of first surface irregularities 150 and/or second surface irregularities 155 can be desirable as the diversity in height H can provide for a visual cue to the consumer of what part of the cap 10 might be most effective for pretreating a stain. For instance, as shown in FIG. 14, the first surface irregularities 155 have the greatest height H proximal the location where the base 20 joins with the vessel wall 60. Since higher first surface irregularities 150 might be perceived by the consumer as being more effective than lower first surface irregularities, the consumer may understand the cap 10 might be designed such that the most effective scrubbing surface is at the edge of the first region 400 proximal where the base 20 joins with the vessel wall 60 and a cap 10 used in such a manner might provide for ergonomic use. The first surface irregularities 150 can vary in height H. The second surface irregularities 155 can vary in height H. The first surface irregularities 150 and the second surface irregularities 155 can vary in height H. First surface irregularities 150 can be bristles 156. First surface irregularities 150 can be bristles 156 that vary in height wherein the height of the bristles increases as a function of distance from the longitudinal axis L. As such the bristles proximal the periphery 50 have a greater height than bristles 156 further from the periphery 50. In such an embodiment, the base exterior 40 can be non-planar (contoured) such that the apexes 420 of the first surface irregularities can be in plane with one another. For bristles 156 having the same cross section as a function of distance from the apex 420, the deformation of each bristle 156 under an applied load increases as a function of height. Thus, longer bristles 156 can be perceived by the consumer as being more flexible, and gentler on the fabric, than shorter bristles 156. Surface irregularities selected from the group consisting of said first surface irregularities, said second surface irregularities, and combinations thereof can vary in height.

The base exterior 40 has a base exterior surface area 41, which is the area of the surface of the base exterior 40. To provide for a cap 10 having a large enough first region 400 to be effective for pretreating stains, the first region 400 can comprise between about 10% to about 90% of the bases exterior surface area 41. To provide for a cap 10 having a large enough second region 410 to be effective for disrupting the formation of a boundary layer of detergent composition 300 between the base exterior 40 and the fabric being pretreated, the second region 410 can comprise between about 10% and about 90% of the base exterior surface area 41 The second region 410 can comprise more than 50% of the base exterior surface area 41.

The first region 400 can comprise less than 50% of the base exterior surface area 41. By having such arrangement, the consumer might be able to better identify that the first region 400 has some unique property and/or capability as compared to other regions or portions of the base exterior 40 because first region 400 contrasts visually with the remainder of the base 20 of the cap. To provide for ergonomic use, the first region 400 can be generally aligned with a portion of the rim 90 having the shape of a spout 92. When the consumer pours a small amount of detergent composition 300 onto a stain via the spout 92, the first region 400 that can be used to pretreat the stain by scrubbing is already in the proper position to be used by the consumer without the consumer having to rotate the cap 10 or change the position of her wrist.

The first region 400 can comprise between about 10% and about 40% of the base exterior surface area 41. The second region can comprise between about 60% and about 90% of the base exterior surface area 41.

One challenge in introducing new product forms to consumers is helping consumers adopt new habits, particularly those habits that can enhance consumer satisfaction with a product. To help consumers understand the functionality of a cap 10 and a method of using cap 10, as disclosed herein, it can be practical to provide usage instruction 430 for the cap 10 that appear on the cap in text form or graphical form. Usage instructions 430 can be advantageously placed on the base 20 so that the consumer sees the usage instruction as she opens the container 110 as she commences to use the product. A text form of a usage instruction can be "Pretreat With X", where X is the brand of detergent composition 300 contained within the container 110. Other usage instructions are contemplated, such usage instruction needing only to inform the consumer of the functionality of the cap 10. A graphical form of a usage instruction can be a pictorial representation of how the cap 10 can be used, such as a human hand gripping the cap 10 in the desired manner and arrows or other indicia to indicate movement.

Figure 15:
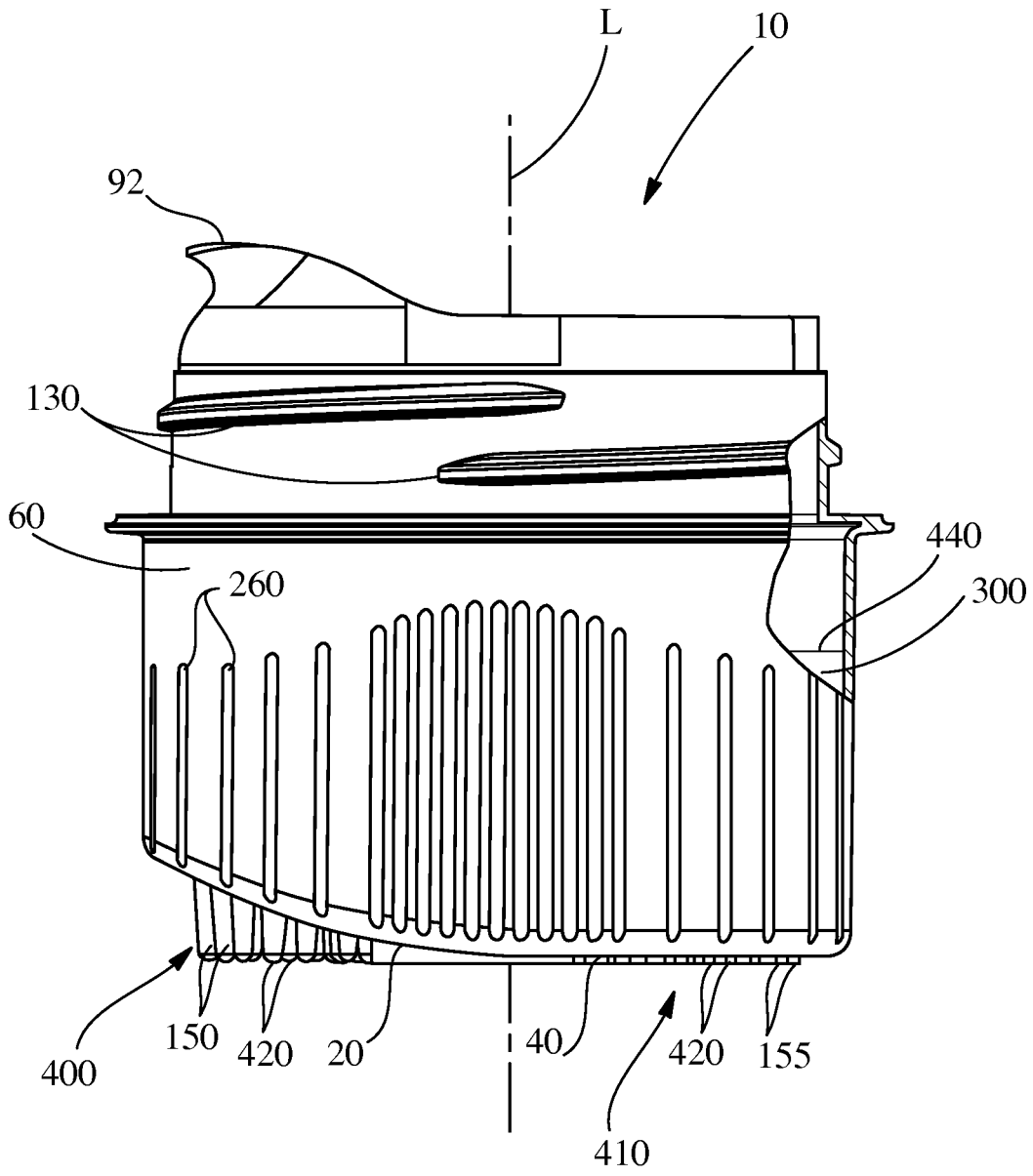
FIG. 15 is profile view of the cap shown in FIG. 14.

A profile view of the cap 10 shown in FIG. 14 is shown in FIG. 15, with a portion of the cap 10 cutaway. As shown in FIG. 15, a plurality of apexes 420 of the first surface irregularities 150 are in plane with apexes 420 of a plurality of second surface irregularities 155 such that the cap 10 can be rested flat. Also shown in FIG. 15 is a phreatic surface 440 of a detergent composition 300 after detergent composition 300 has been poured into the pour volume 100.

III. Methods

Hydrophilic Index

The "Hydrophilic Index" or "HI" for a system of mixed surfactants can be calculated as follows:

$$HI_C = \Sigma_y(\text{weight \% of surfactant } y \text{ in the surfactant system}) \times (HI_S \text{ for surfactant } y). \quad (1)$$

$HI_S$ is calculated for each of the individual surfactants in the mixture as follows:

$$HI_S = 20 \times (\text{the molecular weight of the head group})/(\text{the molecular weight the surfactant}). \quad (2)$$

In the case of ionic surfactants, the $HI_S$ in equation (2) are calculated for the surfactant ions and the weight percents in equation (1) are for the corresponding surfactant ions.

Measurement of the Stain Removal Index

The Stain Removal Index ("SRI) is measured using a modified version of the "Standard Guide for Evaluating Stain Removal Performance in Home Laundering" (ASTM D4265-98). The modifications include the following. At least 4 external replicates and at least 2 internal replicates are tested. The stain is applied by placing the fabric on a flat surface and applying the stain using a pipette for liquids or a brush for solids with a predetermined amount each time. Modified artificial sebum and air filter dirt are not tested. The stains tested are supplied by EMC Empirical Manufacturing Company.

Pretreat Procedure

According to the pretreat (PT) procedure used herein, stains are laid out on a flat level surface and, using a Manostat Syringe (or a similar tool), each stain is covered with 1 mL of detergent composition. To simulate pretreat executions without the benefit of the pretreat cap, the detergent composition is spread lightly to cover the entire stain and allowed to sit for five minutes, then the pretreated stained fabric is introduced into the wash cycle. To simulate pretreat executions with the benefit of the pretreat cap, the detergent composition is rubbed into the stain using the pretreat cap of the invention with 5 strokes in the same direction and allowed to sit for five minutes, then the pretreated stained fabric is introduced into the wash cycle.

IV. Examples

Exemplary Liquid Detergent Compositions

Liquid detergent compositions may be prepared by mixing together the ingredients listed in the proportions shown:

| Ingredient | A Wt % | B Wt % | C Wt % | D Wt % | E Wt % | F Wt % |
|---|---|---|---|---|---|---|
| C12-15 alkyl polyethoxylate (1.8) sulfate | 17.29% | 14.78% | 16.40% | 17.29% | 14.72% | 16.40% |
| C11.8 linear alkylbenzene sulfonic acid | 7.73% | 7.67% | 9.02% | 7.73% | 4.34% | 9.02% |
| C16-17 branched alkyl sulfate | 3.30% | 0.00% | 0.00% | 3.30% | 1.75% | 0.00% |
| C24 alkyl 9-ethoxylate | 1.46% | 1.16% | 1.30% | 1.46% | 1.00% | 1.30% |
| C12-14 alkyl dimethyl amine oxide | 1.03% | 0.77% | 0.97% | 1.03% | 0.60% | 0.97% |
| subtotal surf. | 30.82% | 24.38% | 27.69% | 30.82% | 22.41% | 27.69% |
| citric acid | 0.67% | 0.63% | 0.63% | 0.00% | 3.50% | 1.06% |
| C12-18 fatty acid | 1.52% | 0.90% | 0.90% | 1.52% | 1.52% | 1.29% |
| protease active enzyme protein (Genencor) | 0.06% | 0.07% | 0.07% | 0.06% | 0.07% | 0.07% |
| amylase active enzyme protein (Natalase) | 0.01% | 0.01% | 0.01% | 0.01% | 0.01% | 0.01% |
| mannanase active enzyme protein (Mannaway) | 0.00% | 0.00% | 0.00% | 0.00% | 0.00% | 0.00% |
| xyloglucanase active enzyme protein (Whitezyme) | 0.00% | 0.00% | 0.00% | 0.00% | 0.00% | 0.00% |
| pectate lyase active enzyme protein (Pectawash) | 0.00% | 0.00% | 0.00% | 0.01% | 0.00% | 0.00% |
| lipase active enzyme protein (Lipolex) | 0.00% | 0.00% | 0.00% | 0.03% | 0.00% | 0.00% |
| Borax | 2.53% | 2.40% | 2.40% | 2.53% | 2.46% | 2.40% |
| Ca Formate | 0.09% | 0.09% | 0.09% | 0.09% | 0.09% | 0.09% |
| Soil suspension polymer (alkoxylated polyalkylene imine) | 1.44% | 1.42% | 1.42% | 1.44% | 1.51% | 1.51% |
| Grease cleaning alkoxylated polyalkylene imine) | 1.93% | 1.84% | 1.84% | 1.93% | 1.28% | 1.93% |
| DTPA | 0.34% | 0.34% | 0.34% | 0.34% | 0.34% | 0.63% |
| Tiron | 0.19% | 0.19% | 0.19% | 0.19% | 0.00% | 0.00% |
| Flourescent whitening agent | 0.29% | 0.27% | 0.29% | 0.29% | 0.20% | 0.29% |
| hydrogenated castor oil | 0.12% | 0.10% | 0.12% | 0.00% | 0.00% | 0.12% |
| Mica, titanium dioxide coated | 0.10% | 0.02% | 0.03% | 0.00% | 0.00% | 0.00% |
| Silicone | 0.00% | 0.10% | 0.10% | 0.00% | 0.00% | 0.10% |
| hueing dye | 0.05% | 0.02% | 0.02% | 0.05% | 3.20% | 0.02% |
| Water, perfumes, dyes, buffers, neutralizers, stabilizers, suds suppressors, solvents, and other optional components | to 100% | to 100% | to 100% | to 100% | to 100% | to 100% |

| Ingredient | G Wt % | H Wt % | I Wt % | J Wt % |
|---|---|---|---|---|
| C12-15 alkyl polyethoxylate (3.0) sulfate | 8.5 | — | 4 | 5 |
| C11.8 linear alkylbenzene sulfonc acid | 11.4 | 11 | 12 | 13 |
| C14-15 alkyl 7-ethoxylate | — | 7 | 2 | 3 |
| C12-14 alkyl 7-ethoxylate | 7.6 | 1 | 0.5 | 0.5 |
| C12-14 alkyl dimethyl amine oxide | — | 0.4 | — | — |
| 1,2 Propane diol | 6.0 | 5 | 5 | 3 |
| Ethanol | — | 1 | 1 | 1.5 |
| Di Ethylene Glycol | 4.0 | — | — | 0.2 |
| Na Cumene Sulfonate | — | 1 | 1 | 1 |
| $C_{12-18}$ Fatty Acid | 9.5 | 2.7 | 0.8 | 0.9 |
| Citric acid | 2.8 | 3.3 | 2.3 | 1.9 |
| Protease (40.6 mg/g/)[1] | 1.0 | 0.5 | 0.5 | 0.5 |
| Natalase 200L (29.26 mg/g)[2] | — | 0.1 | 0.1 | 0.1 |
| Termamyl Ultra (25.1 mg/g)[2] | 0.7 | 0.05 | 0.05 | 0.05 |
| Mannaway 25L (25 mg/g)[2] | 0.1 | 0.05 | 0.05 | — |
| Whitezyme (20 mg/g)[2] | 0.2 | 0.05 | 0.05 | 0.05 |
| Fluorescent Whitening Agent | 0.2 | 0.1 | 0.1 | 0.05 |
| Diethylene Triamine Penta Acetic acid | — | — | — | — |
| Diethylene Triamine Penta Methylene Phosphonic acid | 0.5 | 0.4 | 0.30 | 0.30 |
| Hydroxy Ethylidene 1,1 Di Phosphonic acid | — | 0.2 | — | 0.2 |
| 1,2-diydroxybenzene-3,5-disulfonic acid | 0.5 | | 0.15 | 0.15 |
| Soil Suspending Alkoxylated Polyalkylenimine Polymer[3] | — | — | 0.1 | — |

-continued

| | | | | |
|---|---|---|---|---|
| Zwitterionic ethoxylated quaternized sulfated hexamethylene diamine[4] | 2.1 | 0.7 | 0.7 | 1.6 |
| Grease Cleaning Alkoxylated Polyalkylenimine Polymer[5] | — | — | 0.1 | — |
| PEG-PVAc Polymer[6] | 0.9 | 0.8 | 0.8 | 1.3 |
| Hydrogenated castor oil[7] | 0.8 | 0.4 | 0.4 | 0.4 |
| MEA Borate | — | — | 0.2 | — |
| Ca Cl2 | — | 0.05 | 0.05 | 0.05 |
| Sodium formate | — | 0.2 | 0.2 | — |
| Violet DD | — | 0.03 | 0.03 | 0.03 |
| Mica | | — | 0.1 | 0.05 |
| Water, perfumes, dyes, buffers, neutralizers, stabilizers, suds suppressors and other optional components | to 100% pH 8.0-8.2 | To 100% pH 8.0-8.2 | To 100% pH 8.0-8.2 | to 100% pH 8.0-8.2 |

[1]Available from Genencor International, South San Francisco, CA.

[2]Available from Novozymes,, Denmark.

[3]600 g/mol molecular weight polyethylenimine core with 20 ethoxylate groups per —NH. Available from BASF (Ludwigshafen, Germany)

[4]Described in WO 01/05874 and available from BASF (Ludwigshafen, Germany) 600 g/mol molecular weight polyethylenimine core with 24 ethoxylate groups per —NH and 16 propoxylate groups per —NH. Available from BASF (Ludwigshafen, Germany).

[6]PEG-PVA graft copolymer is a polyvinyl acetate grafted polyethylene oxide copolymer having a polyethylene oxide backbone and multiple polyvinyl acetate side chains. The molecular weight of the polyethylene oxide backbone is about 6000 and the weight ratio of the polyethylene oxide to polyvinyl acetate is about 40 to 60 and no more than 1 grafting point per 50 ethylene oxide units. Available from BASF (Ludwigshafen, Germany).

[7]Available under the tradename ThixinR from Elementis Specialties, Highstown, NJ

V. Data

A series of tests are run in order to demonstrate the stain removal performance of the present invention (composition+cap) on grease stains, grass stains, and beverage stains, as well as overall stain removal performance in comparison to the stain removal performance of a comparative product, which contains a hydrophilic surfactant system and has a Hydrophilic Index of greater than 10 (composition+cap), on grease stains, grass stains, and beverage stains, as well as overall stain removal performance.

Table I provides a summary of the comparative data illustrating the greasy stain removal of the detergent compositions of the present invention, which have a Hydrophilic Index of 7.8 and 7.9, in comparison to the greasy stain removal of a comparative detergent composition having a Hydrophilic Index of 10.5

TABLE I low HI detergent compositions (A and B) vs. high HI detergent composition (C)

| FORMULA | A | B | C | | |
|---|---|---|---|---|---|
| HI | 7.8 | 7.9 | 10.5 | | |
| Pre-treated | Y | Y | Y | | |
| Pre-treat cap used | Y | Y | Y | | |
| Total Surfactant % | 30.7 | 27.7 | 30.6 | | |
| AES WT % | 17.3 | 16.4 | 9.7 | | |
| LAS WT % | 7.7 | 9.0 | 6.2 | | |
| HSAS WT % | 3.3 | 0.0 | 0.0 | | |
| NI 24-9 WT % | 1.3 | 1.3 | 14.8 | | |
| Amine Oxide WT % | 1.0 | 1.0 | 0.0 | | |
| | SRI | SRI | SRI | C vs A dSRI | C vs. B dSRI |
| Overall Average | 77.23 | 76.29 | 74.92 | −2.31 | −1.37 |
| Grass | 89.55 | 89.08 | 88.79 | −0.76 | −0.29 |
| Grease Average | 87.78 | 86.57 | 79.92 | −7.86 | −6.66 |
| Grease burnt butter | 96.71 | 96.16 | 96.34 | −0.37 | 0.18 |
| Grease bacon | 95.68 | 95.54 | 90.40 | −5.29 | −5.14 |
| Grease Taco | 81.33 | 76.45 | 66.31 | −15.02 | −10.14 |
| Grease Hamburger | 73.67 | 72.91 | 60.22 | −13.45 | −12.69 |
| Margarine | 91.49 | 91.81 | 86.32 | −5.17 | −5.49 |
| Beverage Average | 64.13 | 61.85 | 64.09 | −0.04 | 2.24 |
| Coffee (instant) | 67.60 | 66.14 | 68.99 | 1.39 | 2.85 |

TABLE I-continued low HI detergent compositions (A and B) vs. high HI detergent composition (C)

| | | | | | |
|---|---|---|---|---|---|
| Tea | 45.86 | 41.83 | 43.90 | −1.96 | 2.07 |
| Wine burgundy | 63.02 | 60.60 | 62.38 | −0.64 | 1.78 |
| Grape Juice | 72.04 | 70.46 | 72.78 | 0.74 | 2.32 |
| Fruit blueberry | 72.11 | 70.21 | 72.39 | 0.28 | 2.18 |
| Particulate Average | 60.35 | 59.43 | 59.07 | −1.27 | −0.36 |
| Clay (U.S.) | 60.35 | 59.43 | 59.07 | −1.27 | −0.36 |
| Make-up replenish | 77.07 | 77.22 | 74.36 | −2.71 | −2.86 |

The data in Table I demonstrates that detergent compositions according to the present invention, A and B above, which have HIs of 7.8 and 7.9, respectively, have grease average SRIs of 87.78 and 86.57, respectively, whereas a comparative composition, C, which has an HI of 10.5, has a grease average SRI of only 79.92, a difference of 7.86 and 6.66 SRI units, respectively.

Table II provides a summary of the comparative data illustrating the particulate stain removal achieved with the cap of the present invention in comparison to the particulate stain removal achieved without the use of the cap of the present invention.

TABLE II low HI detergent compositions (A and B) with cap vs. low HI detergent compositions (A and B) without cap

| FORMULA | A | A | B | B |
|---|---|---|---|---|
| HI | 7.8 | 7.8 | 7.9 | 7.9 |
| Pre-treated | Y | Y | Y | Y |
| Pre-treat cap used | N | Y | N | Y |
| Total Surfactant % | 30.7 | 30.7 | 27.7 | 27.7 |
| AES WT % | 17.3 | 17.3 | 16.4 | 16.4 |
| LAS WT % | 7.7 | 7.7 | 9.0 | 9.0 |
| HSAS WT % | 3.3 | 3.3 | 0.0 | 0.0 |
| NI 24-9 WT % | 1.3 | 1.3 | 1.3 | 1.3 |
| Amine Oxide WT % | 1.0 | 1.0 | 1.0 | 1.0 |

TABLE II-continued

| low HI detergent compositions (A and B) with cap vs. low HI detergent compositions (A and B) without cap | | | | | | |
|---|---|---|---|---|---|---|
| | SRI | SRI | cap vs. no cap dSRI | SRI | SRI | cap vs. no cap dSRI |
| Overall Average | 72.94 | 77.23 | 4.29 | 71.98 | 76.29 | 4.31 |
| Grass | 88.20 | 89.55 | 1.35 | 87.85 | 89.08 | 1.23 |
| Grease Average | 84.89 | 87.78 | 2.89 | 83.94 | 86.57 | 2.63 |
| Grease burnt butter | 95.77 | 96.71 | 0.94 | 95.03 | 96.16 | 1.13 |
| Grease bacon | 95.30 | 95.68 | 0.38 | 95.70 | 95.54 | −0.16 |
| Grease Taco | 71.41 | 81.33 | 9.92 | 69.27 | 76.45 | 7.18 |
| Grease Hamburger | 71.20 | 73.67 | 2.46 | 68.65 | 72.91 | 4.26 |
| Margarine | 90.75 | 91.49 | 0.74 | 91.07 | 91.81 | 0.74 |
| Beverage Average | 61.83 | 64.13 | 2.30 | 59.62 | 61.85 | 2.23 |
| Coffee (instant) | 65.67 | 67.60 | 1.93 | 63.70 | 66.14 | 2.44 |
| Tea | 42.19 | 45.86 | 3.67 | 38.43 | 41.83 | 3.40 |
| Wine burgundy | 61.43 | 63.02 | 1.59 | 58.98 | 60.60 | 1.62 |
| Grape Juice | 69.98 | 72.04 | 2.06 | 67.96 | 70.46 | 2.50 |
| Fruit blueberry | 69.87 | 72.11 | 2.24 | 69.05 | 70.21 | 1.16 |
| Particulate Average | 49.55 | 68.71 | 19.16 | 47.37 | 68.33 | 20.96 |
| Clay (U.S.) | 48.25 | 60.35 | 12.09 | 47.46 | 59.43 | 11.97 |
| Make-up replenish | 50.84 | 77.07 | 26.23 | 47.27 | 77.22 | 29.95 |

The data in Table II demonstrates that the cap of the present invention provides an increase in particulate average SRI of 19.16 units and 20.96 units, for formulas A and B respectively.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A product for pre-treatment and laundering of fabric having a stained portion, said product comprising a pourable aqueous detergent composition and a cap for dispensing said pourable aqueous detergent composition:

A. said pourable aqueous detergent composition comprising:

a) a hydrophobic surfactant system having a Hydrophilic Index of from about 6 to about 9;

B. said cap comprising:

a) a base having a base interior and a base exterior opposing said base interior, said base interior having a periphery; and b) a vessel wall having an interior surface and an exterior surface opposing said interior surface, said vessel wall extending from said periphery to a rim, said interior surface and said base interior defining a pour volume, said base interior forming a closed end of said pour volume;

wherein:

i. said cap is sealingly engaged to a container containing said detergent composition by a connector disposed on said cap and a corresponding receiver disposed on an opening of said container;

ii. said pour volume is sized and dimensioned to provide for a unit dose of said detergent composition, wherein the pour volume is between about 10 mL and about 200 mL;

iii. said cap further comprises a plurality of first surface irregularities at a location selected from the group consisting of: on said rim, on said base exterior, between said connector disposed on said cap and said rim, and combinations thereof; and iv. said cap further comprises a plurality of second surface irregularities at a location selected from the group consisting of on a portion of the base exterior, on a portion of the exterior surface, and combinations thereof.

2. The product according to claim 1, wherein said composition further comprises a chelant system comprising at least two chelants.

3. The product according to claim 1, wherein said composition further comprises a hueing dye.

4. The product according to claim 2, wherein said chelant system comprises a catechol-based chelant and a chelant selected from DTPA, DTPMP and HEDP.

5. The product according to claim 1, wherein said composition further comprises by weight percentage less than about 4.5% citric acid.

6. The product according to claim 1, wherein said composition further comprises by weight percentage less than about 3% citric acid.

7. The product according to claim 6, wherein said composition further comprises a pearlescent agent.

8. The product according to claim 7, wherein said structurant is selected from the group consisting of: hydrogenated castor oil; derivatives of hydrogenated castor oil; microfibrillar cellulose; hydroxyfunctional crystalline materials, long-chain fatty alcohols, 12-hydroxystearic acid; clays; and mixtures thereof.

9. The product according to claim 1, wherein said composition further comprises a structurant.

10. The product according to claim 1, wherein said composition comprises by weight percentage less than about 60% water.

11. The product according to claim 1, wherein said composition further comprises an enzyme selected from the group consisting of: protease; amylase; lipase; cellulase; and mixtures thereof.

12. The product according to claim 1, wherein said hydrophobic surfactant system comprises a surfactant selected from the group consisting of: AES, LAS, nonionic, amine oxide and mixtures thereof.

13. The product according to claim 1, wherein a portion of said rim has the shape of a spout.

14. The product according to claim 1, wherein the plurality of first surface irregularities comprise a first material and another portion of the cap next to the first material comprises a second material, wherein the first material and the second material differ from one another by a property selected from the group consisting of modulus of elasticity, chemical composition, Shore A hardness, color, and combinations thereof.

15. The product according to claim 1, wherein the first surface irregularities differ in shape from the second surface irregularities.

16. The product according to claim 1, wherein plurality of the first surface irregularities and/or the plurality of second surface irregularities are structures selected from the group consisting of rings, ribs, nubs, bristles, fibers, and combinations thereof.

17. The product according to claim 16, wherein the first surface irregularities and/or the second surface irregularities are structures selected from bristles.

* * * * *